US007819711B1

(12) United States Patent
Wolske

(10) Patent No.: US 7,819,711 B1
(45) Date of Patent: Oct. 26, 2010

(54) RETRACTABLE THRUST REVERSING BUCKET FOR BOAT PROPELLER

(75) Inventor: James P. von Wolske, 2107 Lakeshore Dr., Austin, TX (US) 78746

(73) Assignee: James P. von Wolske, Austin, TX (US)

( * ) Notice: Subject to any disclaimer, the term of this patent is extended or adjusted under 35 U.S.C. 154(b) by 0 days.

(21) Appl. No.: 11/674,885

(22) Filed: Feb. 14, 2007

Related U.S. Application Data

(60) Provisional application No. 60/773,392, filed on Feb. 15, 2006.

(51) Int. Cl.
*B63H 11/11* (2006.01)

(52) U.S. Cl. ..... 440/41

(58) Field of Classification Search ..... 440/42, 440/41

See application file for complete search history.

(56) References Cited

U.S. PATENT DOCUMENTS

| | | | | |
|---|---|---|---|---|
| 1,186,210 | A | 6/1916 | Kitchen et al. | |
| 2,735,264 | A * | 2/1956 | Jewett | 239/265.37 |
| 3,030,909 | A | 4/1962 | Barnes et al. | |
| 3,102,389 | A | 9/1963 | Pedersen et al. | |
| 3,137,266 | A * | 6/1964 | Perrier et al. | 440/43 |
| 3,258,916 | A | 7/1966 | Lehmann | |
| 3,306,046 | A * | 2/1967 | Trapp | 60/222 |
| 3,347,203 | A * | 10/1967 | Starry | 440/41 |
| 3,465,705 | A | 9/1969 | Castoldi | |
| 3,515,087 | A | 6/1970 | Stuart | |
| 3,520,265 | A | 7/1970 | Sanford | |
| 3,531,940 | A | 10/1970 | Markowski | |
| 3,680,315 | A | 8/1972 | Aschauer et al. | |
| 3,791,334 | A | 2/1974 | Wetzel | |
| 3,807,346 | A * | 4/1974 | Delfeld | 440/41 |
| 3,824,946 | A | 7/1974 | Macardy et al. | |
| 3,906,885 | A | 9/1975 | Woodfill | |
| 3,961,591 | A | 6/1976 | Fuller | |
| 3,970,030 | A | 7/1976 | Stangeland | |
| 4,015,556 | A | 4/1977 | Bordiga | |
| 4,026,231 | A | 5/1977 | Fedorko | |
| 4,138,963 | A | 2/1979 | Thompson | |
| 4,214,544 | A | 7/1980 | Dashew et al. | |
| 4,252,075 | A | 2/1981 | Kobayashi | |
| 4,315,749 | A | 2/1982 | Baker et al. | |
| 4,474,561 | A | 10/1984 | Haglund | |
| 4,509,923 | A | 4/1985 | Turnbull | |
| 4,538,997 | A | 9/1985 | Haglund | |
| 4,808,132 | A | 2/1989 | Douglas | |
| 4,895,093 | A | 1/1990 | Dalsbo | |
| 4,977,845 | A | 12/1990 | Rundquist | |

(Continued)

*Primary Examiner*—Stephen Avila
(74) *Attorney, Agent, or Firm*—Gary R. Stanford

(57) ABSTRACT

A thrust bucket for use on a boat propeller including a plenum and a positioning system. The plenum includes a plenum wall with at least one water flow valve located on the plenum wall. The positioning system moves the plenum between inoperative and operative positions. The thrust bucket may include an annulus positioned in close proximity to a swept radius of the propeller when the plenum is in the operative position. The at least one operable water flow valve may be controlled to control a direction of water departing the plenum, or to control a quantity of water flow out of the plenum. The thrust bucket may further include a propeller guard mounted to the plenum and positioned at an inlet side of the propeller.

26 Claims, 25 Drawing Sheets

U.S. PATENT DOCUMENTS

| | | | | |
|---|---|---|---|---|
| 4,992,065 | A | 2/1991 | Torneman et al. | |
| 5,072,579 | A | 12/1991 | Gongwer | |
| 5,140,926 | A | 8/1992 | Denston | |
| 5,305,701 | A | 4/1994 | Wilson | |
| 5,312,275 | A | 5/1994 | Place | |
| 5,344,344 | A | 9/1994 | Forsstrom | |
| 5,667,415 | A | 9/1997 | Arneson | |
| 5,752,864 | A | 5/1998 | Jones et al. | |
| 6,009,822 | A | 1/2000 | Aron | |
| 6,227,919 | B1 | 5/2001 | Blanchard | |
| 6,325,010 | B1 | 12/2001 | Gruenwald | |
| 6,464,549 | B2 | 10/2002 | Buzzi | |
| 6,554,660 | B2 * | 4/2003 | Irish | 440/38 |

* cited by examiner

RETRACTABLE THRUST REVERSING BUCKET FOR BOAT PROPELLER

CROSS-REFERENCE TO RELATED APPLICATIONS

This application claims the benefit of U.S. Provisional Application Ser. No. 60/773,392, filed on Feb. 15, 2006, which is herein incorporated by reference for all intents and purposes.

BACKGROUND OF THE INVENTION

1. Field of the Invention

The present invention relates to watercraft, and more particularly to a thrust reversing bucket for low speed maneuvering including reverse, neutral, side and forward thrust motion of a boat with a propeller.

2. Description of the Related Art

The term thrust bucket or thrust reversing bucket is carry-over language from jet engines for airplanes or water jet pump propulsion systems for boats. Existing thrust buckets maintain the water velocity at an orderly, high speed flow and simply curves the flow into another direction to slow down the jet boat or maneuver the jet boat rearward or sideways as desired. In water jet applications, the velocity energy is maintained relatively constant as the water goes through the bucket. Most conventional thrust buckets were used on water jet propulsion boats because the water pump impeller rotation cannot be effectively reversed. Conventional thrust reversing buckets for water pump jet drives do not contemplate a propeller.

Thrust buckets were rarely used on propeller driven boats because reverse rotation of the propeller together with steering the propeller or rudder usually sufficed for low speed maneuvering in the reverse direction or for slowing down the forward motion of the boat.

There are a few thrust reversing bucket type systems designed for propeller driven boats. One thrust reversing bucket for a propeller has directional control but requires that the thrust bucket be partially withdrawn from the propeller discharge to vary the ratio of forward thrust to rearward thrust. This system uses a single diverter vane that is common to two separate discharges comprised of a port water course and a starboard water course. In other designs, the entire bucket tilts or turns to deflect the propeller flow. Also, other conventional thrust buckets do not retract the mechanism fully from the propeller under high speed forward operation of a boat, but rather some or all of the mechanisms stay in the water as a propeller shroud or side rudder and cause a continuous force on the boat. And lastly, existing deployable thrust buckets do not have an annulus in the plane of the propeller to capture and contain the flow of water from the propeller and which can be retracted to a position wherein it does not affect the force on the boat.

Usually, the higher the design speed of a boat, the more specialized is the propeller. These high speed propellers have blades which are asymmetric and perform poorly when operating in reverse rotation. One such type of propeller is known as a "cleaver" propeller. Slow speed maneuvering of such boats has been particularly difficult. In general, nearly all of the operation of a typical boat is in the forward direction and at a high rate of speed. However, there are occasions, even for high speed boat designs, when low speed maneuverability is desirable. Conventional types of propulsion are deficient in maneuvering when operating in low speed mode. Although it is understood that only a small portion of time is spent reversing or side maneuvering in a docking or undocking situation, good maneuvering is an important benefit to safety and operability

BRIEF DESCRIPTION OF THE DRAWINGS

The benefits, features, and advantages of the present invention will become better understood with regard to the following description, and accompanying drawings, in which:

FIG. 16 shows a retraction means similar to that of FIG. 10 that allows the thrust bucket to be moved rearward to clear the blade tips of the propeller and further be moved upward to the retracted position.

FIG. 23 is a view of FIG. 24 looking along Section line 23-23.

FIG. 30 shows a part of the thrust bucket as a portion of a semicircle under the propeller to serve as part of an annulus around the propeller when in the deployed position.

FIG. 43 shows how, when deployed, the three jaws of the thrust bucket overlap to make a complete cover around the propeller. The annulus is formed by the separate arc sections of each of the three pieces.

FIG. 60 shows the three jaws of the thrust bucket somewhat rotated to the horizontal plane. The respective pieces are shown rotated to the same horizontal position to illustrate relative nesting position, but which is not a normal operating position.

FIG. 65 includes a cable means for moving the thrust bucket between a retracted position and a deployed position.

DETAILED DESCRIPTION

Figure 1:
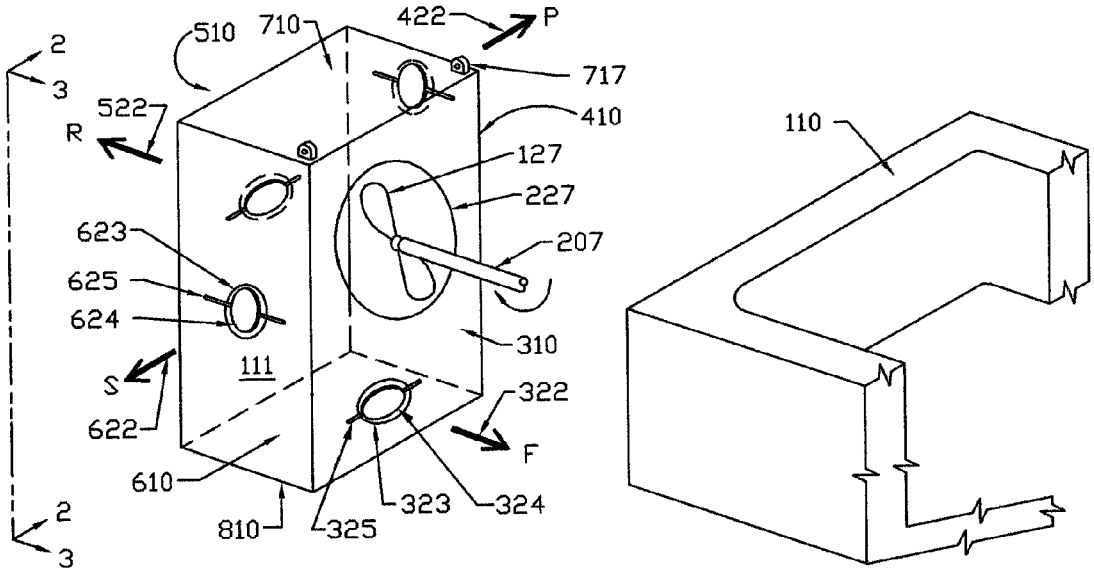
FIG. 1 is a perspective view of a partial rear end of a boat with a propeller and a thrust bucket implemented according to an embodiment in a deployed position.

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

Embodiments according to the present invention provide a means for improved slow speed maneuvering of boats employing specialized propellers such as cleaver propellers and the like. Embodiments according to the present invention do not stop or reverse the direction of rotation of the propeller, but rather converts the velocity energy of the propeller into pressure energy contained in a plenum, and then converts and can independently direct that pressure energy to any of several independent directional water jets to urge the boat in a desired direction. The boat moves in response to the action and reaction principals of Isaac Newton. A plenum is a chamber including plenum walls for enclosing a fluid and has at least one area where fluid can enter the chamber and at least one area where fluid can discharge from the chamber. In various embodiments described herein, an annulus is included to further define the area in which fluid enters the chamber of the plenum. An annulus is a hole in the plenum wall that is usually, but not necessarily, circular. The use of an annulus is secondary to the reliable deployment of the plenum to the proximate position of the propeller. So an annulus is desirable, but not essential, and a partial annulus is also sufficient.

Embodiments according to the present invention solve the low speed maneuvering problems by the use of a system that somewhat resembles a thrust reversing bucket, or more broadly a thrust diverting bucket, but uses different means and methods to capture and redirect the propeller flow in any of several independently or simultaneously selectable directions in a controlled manner. A thrust bucket is a means for redirecting or modulating an entering stream of fluid from one direction to any of several other directions including the same direction. A thrust bucket includes a plenum and plenum walls, and a face of the thrust bucket is any of several plenum walls. For example, a forward face is the forward plenum wall. Other faces are defined similarly with regards to the location or orientation. Therefore the starboard face is the plenum wall located on the starboard side of the thrust bucket. When the boat is running in a normal forward speed condition, the thrust bucket is retracted out of the way of the propeller flow and is thus inoperative and therefore it does not affect the thrust forces on the boat conversely to some prior art in which the thrust bucket forms part of the normally operating steering mechanism.

Embodiments according to the present invention also exceed conventional designs by serving as a propeller guard to protect the propeller from damage and further serves as a propeller screen or propeller cage on the water entering side of the propeller to protect swimmers or marine mammals from injury.

A retractable thrust reversing bucket according to an embodiment of the present invention enables low speed, multidirectional maneuvering of a boat with a propeller. The propeller thrust bucket comprises a combination of a plenum of at least one section and at least one independently operable water flow valve for independent control of an independent water jet in a direction different from the propeller thrust direction. The combination converts the unidirectional flow of the propeller discharge to a selectable flow in a preferred direction. The plenum may also include an annulus in the plane of the propeller to minimize leakage at the propeller blade tips. The thrust bucket is movable between a deployed position where it is operative to affect the thrust on the boat and a retracted position wherein it is inoperative and does not affect the thrust on the boat. An alternative construction for the thrust bucket comprises multiple sections, or jaws, that nest together when in the retracted position. One embodiment includes multiple water flow valves to control multiple and different directional water jets. When in the deployed position, the plenum covers the blades to further act as a propeller guard to protect the propeller and also as a propeller screen or propeller cage to protect swimmers and marine mammals. A retractable thrust reversing bucket according to an embodiment of the present invention includes a plenum that is movable between a deployed or operative position and a retracted, or inoperative, position. A thrust bucket according to one embodiment of the present invention uses directional water flow control to eliminate the need for a reversing gear and clutch, and reduces the need for independent side thrusters for slow speed maneuvering. A thrust bucket according to an embodiment of the present invention can also include a plenum with multiple sections that nest together to form a more compact profile when in the retracted position. Thrust buckets according to various embodiments of the present invention are primarily directed towards high speed planing boats that require improved maneuverability in slow speed docking and undocking situations. A further benefit is that, when deployed, the plenum, together with the inlet screens, prevents propeller strikes or propeller fouling.

Figure 3:
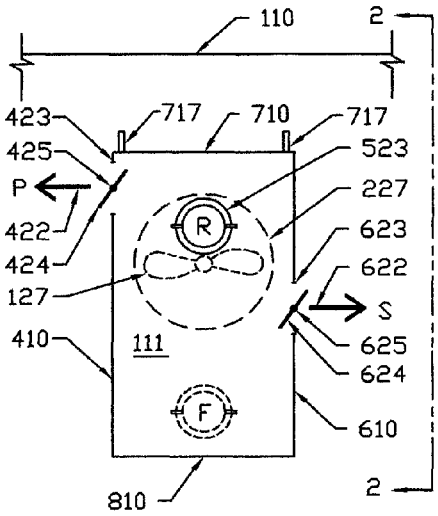
FIG. 3 is a rear end view of the partial rear end of the boat with the propeller and the thrust bucket looking along Section line 3-3 of FIG. 1.
Figure 2:
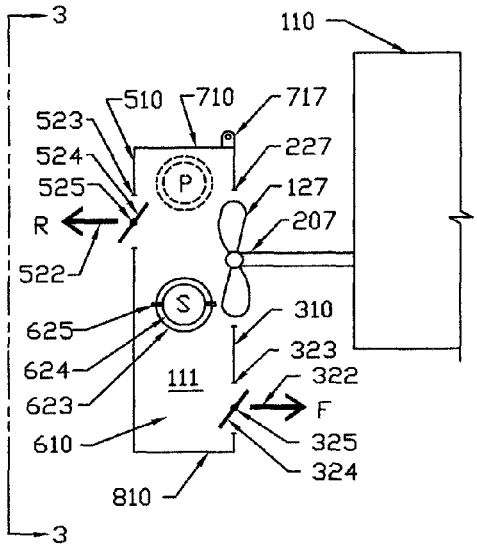
FIG. 2 is a side view of the partial rear end of the boat with the propeller and the thrust bucket looking along Section line 2-2 of FIG. 1.
Figure 67:
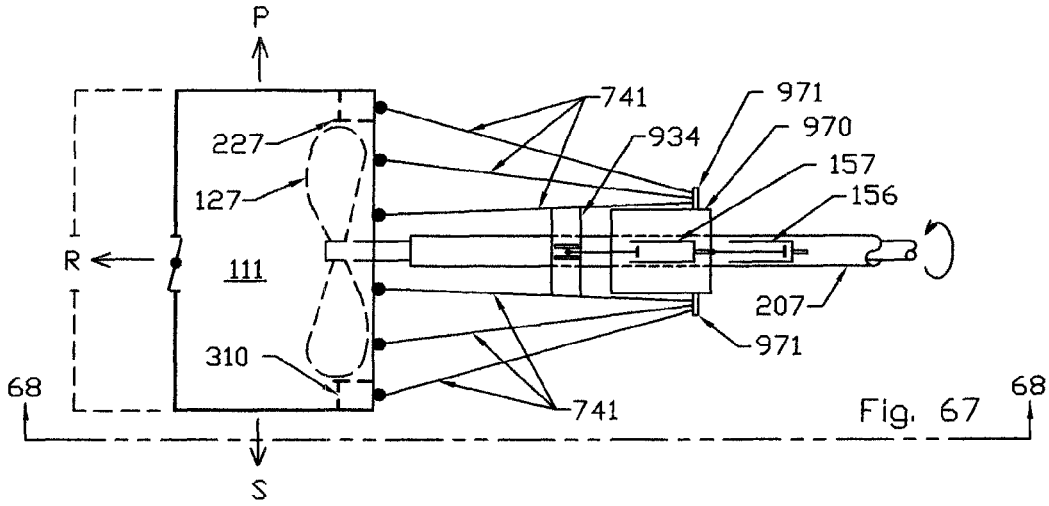
FIG. 67 is a top view of propeller and propeller shaft carrier and a single piece thrust bucket according to another embodiment including a means for mounting and retracting the bucket.
Figure 68:
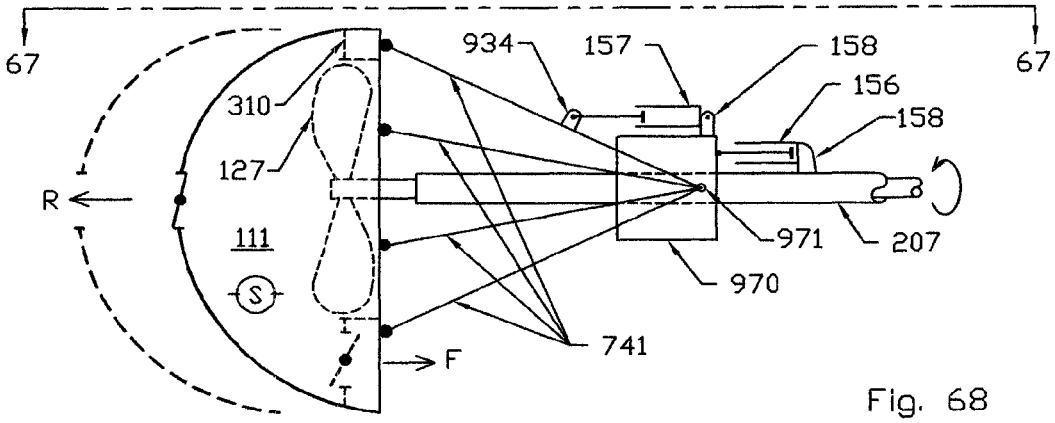
FIG. 68 is a side view of the propeller and propeller shaft carrier and the single piece thrust bucket of FIG. 67 showing the details of the mounting and deploying mechanism for the thrust bucket comprising a bracket and two linear force actuators. The lower actuator moves the thrust bucket forward and rearward on the propeller shaft carrier to place the blade tips well into the annulus, and the upper actuator moves to pivot the thrust bracket up into the retracted position. The rearward intermediate position of the thrust bucket is shown by the dotted, curved line to the left of the solid, curved line of the thrust bucket when in the deployed position.
Figure 69:
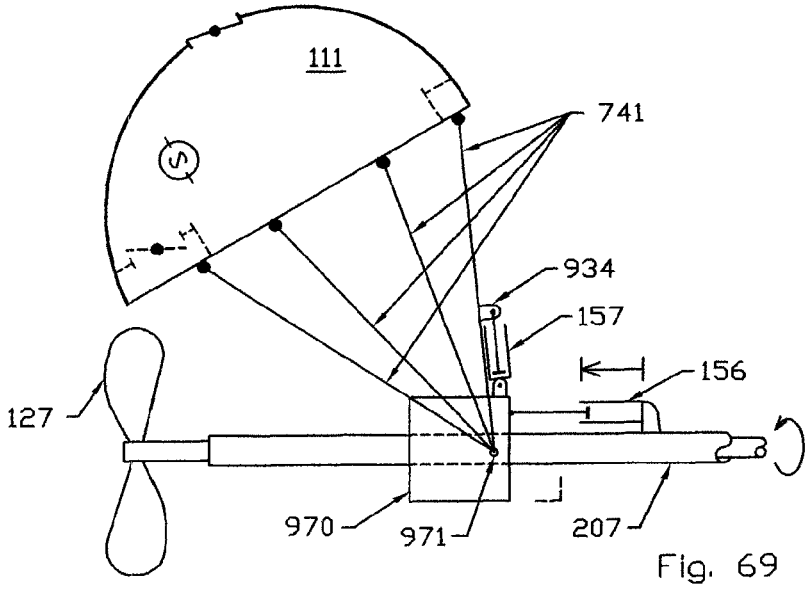
FIG. 69 is another side view of the propeller and propeller shaft carrier and single piece thrust bucket according to another embodiment similar to that of FIG. 68 showing the thrust bucket in the refracted position above and forward of the propeller.

FIGS. 1-3 show the functional workings of the thrust bucket. FIGS. 4-36 show embodiments of the invention mounted on several types of boat propulsion systems with the thrust bucket in the deployed position and usually the means to move it to the retracted position. FIGS. 37-41 show a two piece thrust bucket. FIGS. 42-53 show a three piece thrust bucket. FIGS. 54-58 show a four piece thrust bucket that is a minor variation of the three piece bucket. FIGS. 59-66 show a three piece bucket including mounting and retracting means particularly suited for surface drive propulsion where the propeller is mounted at the end of a shaft extending rearward from the boat. FIG. 67-69 shows a one piece thrust bucket and a means to deploy and retract it. FIG. 70-77 show the various types of water valves used on the thrust bucket. In all of the figures, item numbers in parentheses indicate that the item is in the refracted position away from the propeller, bold arrows show the directional water jets that issue from the thrust bucket in the respective directions as follows, F (forward), R (rearward), P (port), and S (starboard), and Section lines with an arrowhead and number at each end refer to a view as seen in the figure bearing the same number.

FIG. 1 is a perspective view of the rear portion of a boat 110 with a propeller 127 connected to a propeller shaft that is coaxially mounted to rotate inside a propeller shaft carrier 207. This drawing is necessarily schematic to best show the thrust producing functional relationship of the significant parts. Later figures will show the thrust bucket as a more streamlined assembly more suitable for installation on a boat. A thrust bucket 111 is shown rearward of the boat and in proximate location to the propeller. The thrust bucket comprises a plenum that is pressurized with water from the spinning propeller. The forward face 310 of the thrust bucket includes an annulus 227 around the perimeter of the propeller blade tips and located close to the plane of the spinning propeller.

The annulus is part of the plenum that serves to prevent leakage around the tips of the propeller blades. Although the system would work with larger clearances around the blade tips, the amount of water blow back would be undesirable and simply require the propeller to run faster to push enough water into the bucket to generate enough pressure to move the boat effectively when the thrust valves are opened. Excessive water that leaks around the tips of the propeller blades reduces efficiency, however, that water usually just strikes the transom or may go back under the boat, but in either case, the net force on the boat is disorganized and often cancelled. But, as a practical matter, the inefficiency of the system when doing slow speed maneuvering is not important to the fuel efficiency of the boat because it is done for such a short duration of the overall run time and the engine has plenty of power to spin the propeller at these low speeds. The close fit of the annulus around the propeller, and in fact even the mere presence of the annulus, is secondary to the reliable deployment of the thrust bucket to the proximate position of the propeller. So the annulus is desirable, but not essential. And a partial annulus is also sufficient.

The forward face 310 of the thrust bucket also has a forward water flow valve 324 mounted to a valve shaft 325 located in a valve orifice 323. The forward water jet 322, shown as a bold arrow, represents water that is emitted from the thrust bucket when the forward water flow valve is open. The starboard face 610 of the thrust bucket has a water flow valve similar to the forward face and is comprised of a starboard water flow valve 624 and valve shaft 625 located in valve orifice 623. The starboard water jet 622, shown as a bold arrow, represents water that is emitted from the thrust bucket when the starboard water flow valve is open. The port face 410 of the thrust bucket is similar to the starboard face and has a port water flow valve 424 and a port water jet 422 shown as a bold arrow. The rearward face 510 of the thrust bucket is similar to the forward face and has a rearward water flow valve 524 and a rearward water jet 522 shown as a bold arrow. The bold arrows indicate the velocity vector of the water flow out of the thrust bucket. The thrust bucket is closed on top by the top face 710 and closed on the bottom by the bottom face 810. Two mounting lugs 717 are shown on the top of the thrust bucket. When all of the valves are closed, there is no net thrust generated and the thrust bucket is considered to be in "Neutral". Conversely, water jets in opposing directions can be opened to the extent necessary to just cancel the opposing thrust forces as a means to also establish "Neutral". When forward water flow valve 324 is open and forward water jet 322 is flowing out of the thrust bucket, the boat is urged rearward in response to Newton's laws of action and reaction. Likewise each of the other water jets causes a force on the boat in a direction opposite to the water flow vector. It is also contemplated that as few as one thrust valve mounted on the thrust bucket, yet as many as four or more can be mounted to provide thrust in each of the four horizontal directions. This thrust bucket provides an improvement over conventional designs in that a thrust bucket implemented according to an embodiment of the present invention can be used on both fixed and movable propellers.

FIG. 2 is a side view of FIG. 1 and shows the starboard side of the boat 110 and the starboard face 610 of the thrust bucket 111. A forward water flow valve 324 located on the forward face 310 of the thrust bucket issues a stream of water shown as the forward water jet 322 that flows out under the boat bottom 110 to force the boat to the rearward direction. A rearward thrust valve 524 located on the rearward face 510 of the thrust bucket issues a stream of water as the rearward water jet 522 to force the boat to the forward direction.

FIG. 3 is a rear end view of FIG. 2 and shows the rear end of the boat 110 and the rearward face 510 of the thrust bucket 111. The propeller 127 is hidden from view. A starboard thrust valve 624 located on starboard face 610 of the thrust bucket issues a stream of water as the starboard water jet 622 to force the boat to the port direction. Conversely, a port thrust valve 424 located on the port face 410 of the thrust bucket issues a stream of water as the port water jet 422 to force the boat to the starboard direction.

Figure 4:
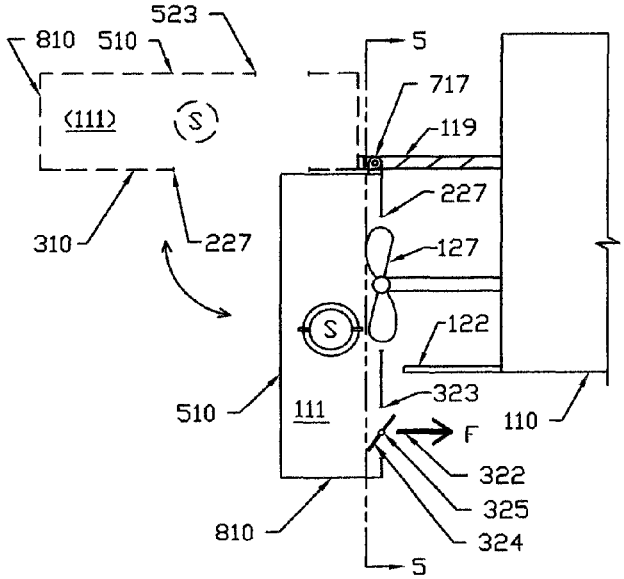
FIG. 4 is a side view of the partial rear end of the boat and the propeller as shown in FIG. 2 including the thrust bucket in a deployed position as shown as a solid line and the thrust bucket hinged upward in a retracted position as shown as a dotted line.

FIG. 4 shows the thrust bucket of FIG. 2 mounted to a boat that has a surface drive type of propeller 127 and wherein the boat has a hull extension 122 at the base of the transom similar to a trim tab or the like. The thrust bucket is connected to a swim platform 119 or other similar hull extension by a hinge 717 to allow the raised thrust bucket (111) to move upward and away from the propeller when in the retracted position. Note how the raised thrust bucket serves as a propeller shield to prevent people from falling on the exposed blades. Also note how the thrust bucket serves as a propeller shield when in the lowered position to protect swimmers or marine mammals from the propeller whether the propeller is spinning or not spinning.

Figure 5:
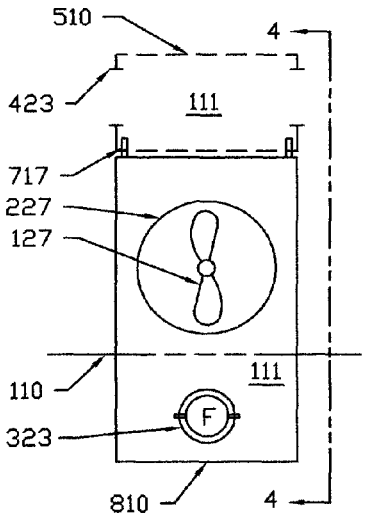
FIG. 5 is a rear end view of the partial rear end of the boat with the propeller as shown in FIG. 3 and looking along lines 4-4 of FIG. 4 including the thrust bucket in a deployed position as shown by a solid line and as movable upward by means of a hinge to a retracted position as shown by a dotted line.

FIG. 5 shows a rear end view of FIG. 4 and shows similar but abbreviated features of FIG. 3. The bottom plane of the boat 110 is given emphasis to show how the forward water jet 322 is located below that plane to allow the water to pass cleanly under the boat. The bottom plane may be flat or sloped or straight or curved.

Figure 6:
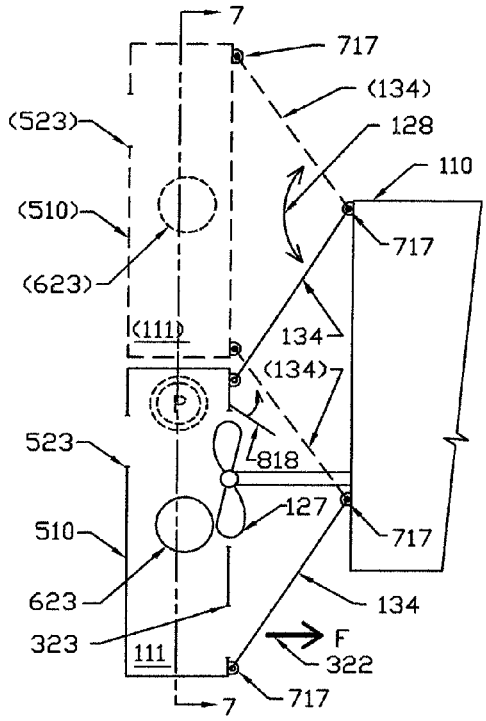
FIG. 6 is a side view of the boat as shown in FIG. 4 and looking along Section line 6-6 of FIG. 7 showing the thrust bucket in the deployed position as a solid line and in the retracted position as a dotted line as movable upwards to a retracted position by a means different from that shown in FIG. 4.

FIG. 6 is a side view similar to FIG. 2 but shows a means to move the thrust bucket 111 to a retracted position (111). Four swing rods 134 mounted by hinges 717 to each of the four corners of the thrust bucket and in turn to hinges 717 on the boat 110 allow the thrust bucket to move between the deployed position and the retracted position.

Figure 7:
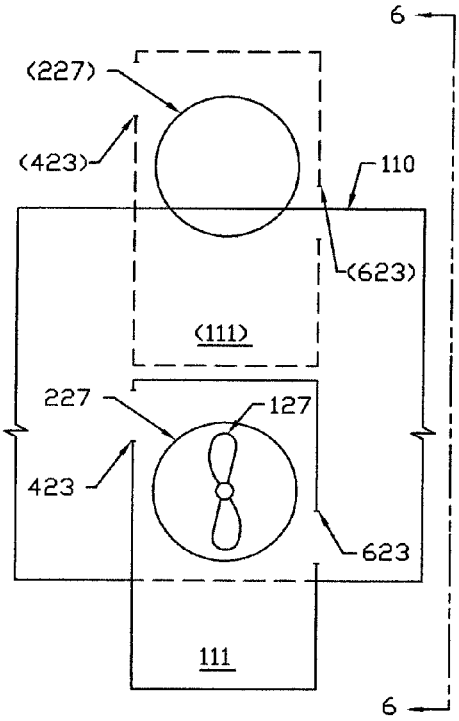
FIG. 7 is a rear end view of the boat and the propeller looking along Section line 7-7 of FIG. 6 showing the thrust bucket in the deployed position as shown by a solid line and as raised to a retracted position as shown by a dotted line.

FIG. 7 is a rear end view of FIG. 6 and shows the thrust bucket 111 in the deployed position in solid line and in the retracted position (111) in dotted line for the raised thrust bucket.

Figure 8:
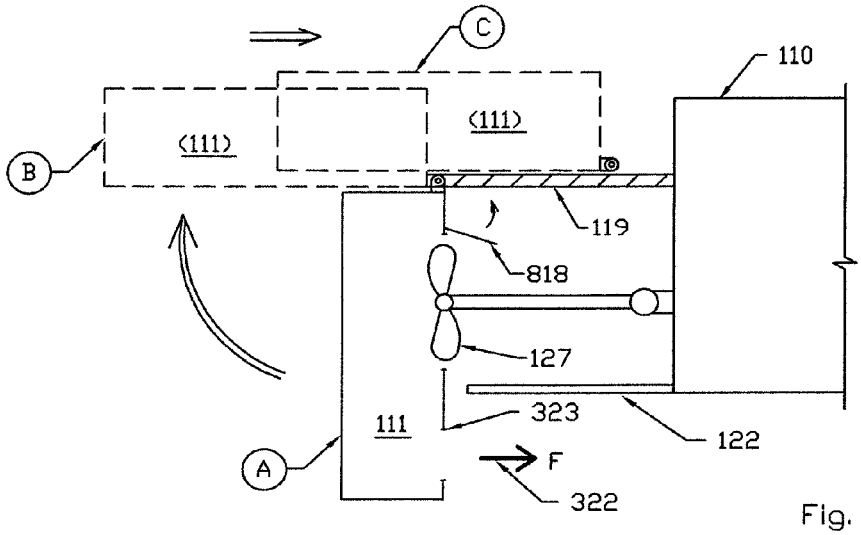
FIG. 8 is a side view of the rear end of a boat with a propeller according to another embodiment including a swim platform, or other rigid extension, and a thrust bucket in a deployed position "A" as shown as a solid line and a means to move the thrust bucket to a retracted position as shown as a dotted line in a two step progression of hinged motion to position "B" and sliding motion to position "C".

FIG. 8 is side view similar to FIG. 4 and shows a means to move the thrust bucket 111 by means of hinges and slide rails to bring the thrust bucket forward over the swim platform 119. Position A is the deployed position, position B is the intermediate position, and position C is the fully retracted position.

Figure 9:
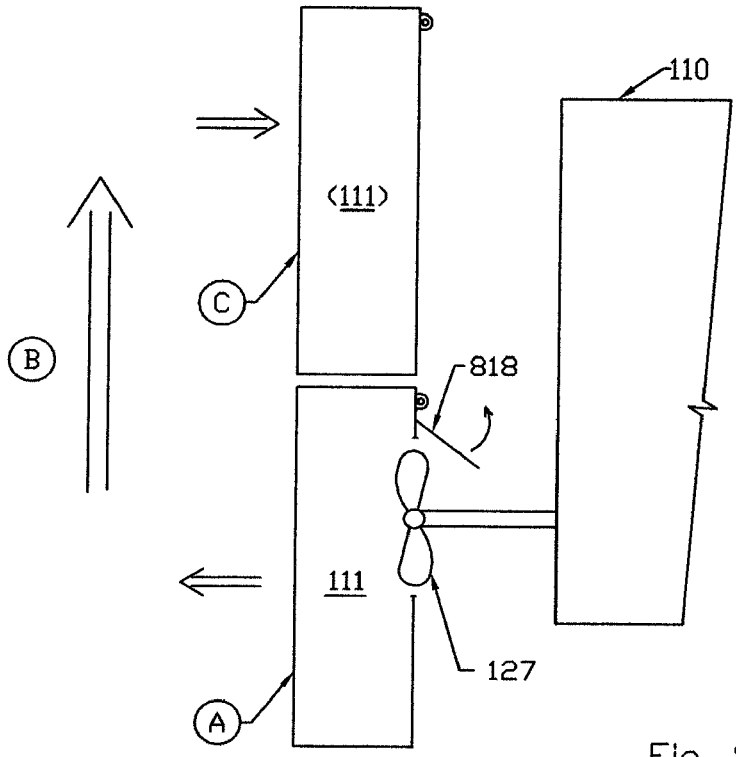
FIG. 9 is a side view of the rear end of a boat with a propeller and a thrust bucket according to another embodiment similar to FIG. 6 and shows that the thrust bucket in the deployed position "A" must be moved rearward to allow the propeller to clear the front edge of the thrust bucket in order for the thrust bucket to be raised "B" and then be further moved forward to position "C" in order to maintain a compact profile on the boat.

FIG. 9 is a side view similar to FIG. 6 and shows a path to move the thrust bucket 111 from a deployed position A outward to clear the propeller 127, to an intermediate position B and upward, and then inward to a retracted position C.

Figure 10:
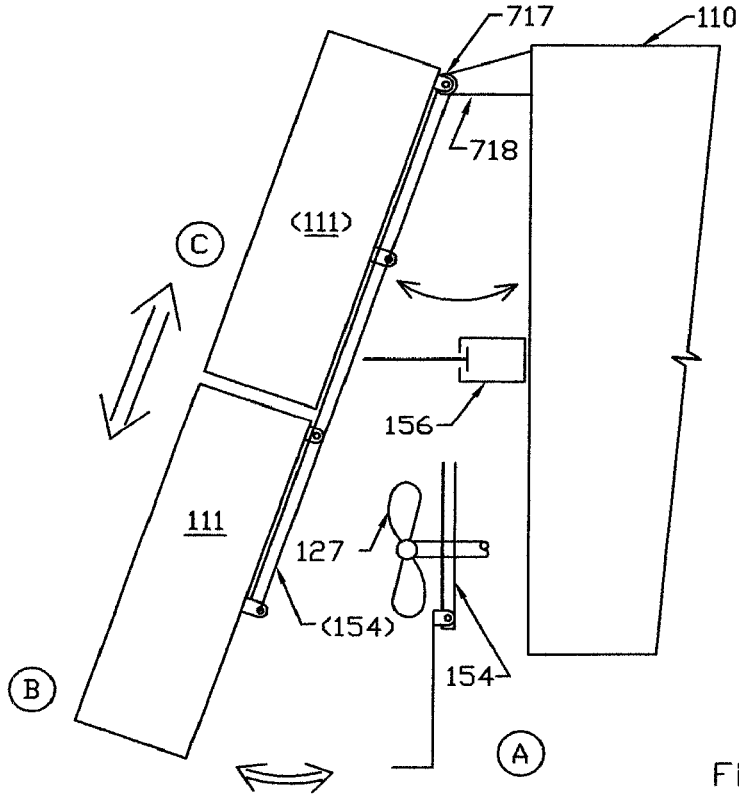
FIG. 10 is a side view of the rear end of a boat with a propeller according to another embodiment similar to FIG. 6 and FIG. 9 showing other means for retracting the thrust bucket by means of a hinged track mounted, for example, to the top of the transom of the boat that allows the deployed thrust bucket shown as position "A" to be swung away from the propeller blades to position "B" and slid upwards to the retracted position "C" as indicated with the item number enclosed in parentheses.

FIG. 10 is a view similar to FIG. 9 and shows how the motion of the path shown in FIG. 9 can be accomplished by a combination of a pair of roller rails 154 connected to the boat by hinges 717 and hinge standoffs 718 and a force ram 156 to cause the thrust bucket 111 originally in the deployed position A to be pushed rearward clear of the propeller 127 to position B and then to the fully retracted position C. The force ram can then move the roller rails back to position A. The reverse sequence is used to move the refracted thrust bucket (111) to the deployed position.

Figure 12:
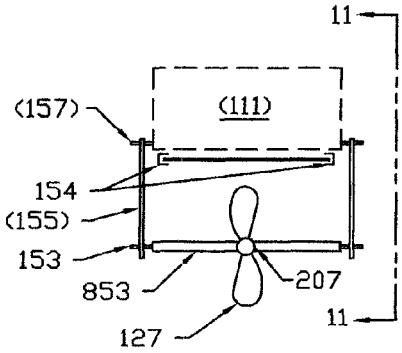
FIG. 12 is a rear end view looking along Section line 12-12 of FIG. 11 showing the propeller and the support structure that connects the thrust bucket to the propeller shaft carrier in which the thrust bucket is shown in the raised or retracted position as illustrated by a dotted line with the item number enclosed in parentheses.
Figure 11:
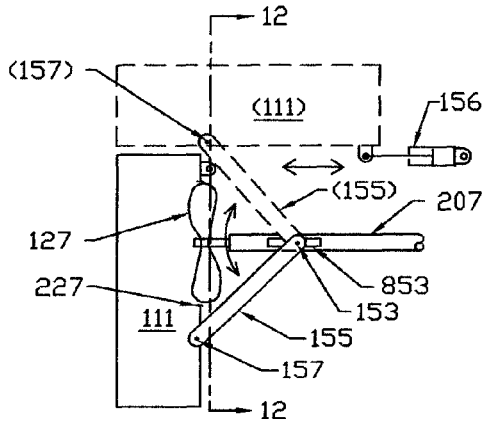
FIG. 11 is a side view of another embodiment for a surface drive type of propulsion with a propeller mounted on an extended shaft with the thrust bucket in a deployed position as shown by a solid line and in a retracted position as shown by a dotted line in which the thrust bucket is movable by combined means of translation and rotation.

FIG. 11 is a side view similar to FIG. 8 but shows how the thrust bucket 111 can be retracted by means of bracket 853 attached to propeller shaft carrier 207 and by swing arms 155 that have pivot pins 153 on the end connected to the bracket and pivot pins 157 on the other end connected to the thrust bucket. FIG. 12 shows pair of guide rails 154 to constrain the upper end of the thrust bucket to follow a generally horizontal path as it is pulled and pushed by force ram 156. Therefore, when the force ram pulls the top end of the thrust bucket towards the boat the lower ends of swing arms 155 push the lower end of the thrust bucket outward away from propeller 127 to clear the lower edge of annulus 227 from touching the blade tips of the propeller. As the thrust bucket is pulled forward the lower edge of the bucket and annulus is pushed outward until the swing arms are horizontal and then the thrust bucket is pulled forward over the top of the propeller to the fully retracted position (111).

FIG. 12 is a rear end view of FIG. 11 and shows the bracket 853 extending outward on either side of the propeller shaft carrier 207 and the two swing arms 155 connected to the bracket by pivot pins 153 and in turn connected to the thrust bucket 111 by pivot pins 157. Two guide rails 154 constrain the top of the thrust bucket to move generally horizontally above propeller 127.

Figure 13:
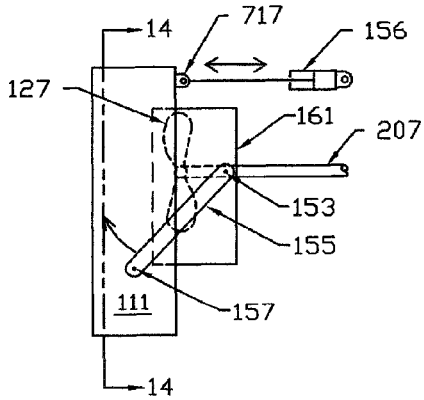
FIG. 13 is a side view of another embodiment similar to FIG. 11 of a surface drive type of propulsion with a propeller mounted on an extended shaft but wherein the propeller has a prior art fixed shroud surrounding at least a partial arc around the propeller. In this case a thrust bucket in the deployed position is shown with associated retraction mechanism similar to that of FIG. 11 to enable the thrust bucket to move to a retracted position.

FIG. 13 is a side view similar to FIG. 11 but wherein propeller 127 has a shroud 161 of prior art affixed over a part of the propeller. The shroud acts as an attachment point for the pivot pins 153 without the need for a bracket 853 as shown in FIG. 11. This embodiment uses the upper portion of the shroud as part of the annulus for the propeller. Force ram 156 pulls forward on the top edge of the thrust bucket through hinge 717 and causes the lower end of the bucket to swing rearward and upward on the ends of swing arms 155 connected to the lower end of the thrust bucket by pivot pins 157. The curved arrow above pivot pin 157 shows the path taken by the lower ends of the swing arms as they pivot about pivot pins 153.

Figure 14:
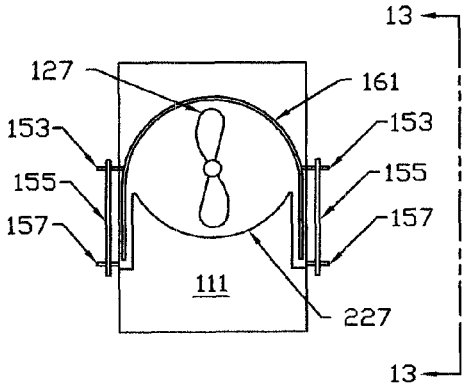
FIG. 14 is a rear end view of the thrust bucket and the propeller along Section line 14-14 of FIG. 13 and shows how the partial arc of the shroud plus the partial arc of the thrust bucket form an annulus around the propeller.

FIG. 14 is a rear end view of FIG. 13 and shows pivot pins 153 connecting swing arms 155 to shroud 161 and pivot pins 157 connecting the swing arms to the thrust bucket 111. The thrust bucket rides on the top edge of the shroud and the radius 227 is the lower edge of annulus 227 that is notched to accommodate the lower straight leg extensions of the shroud. The lower legs of the shroud may also be considered as simply side mounted skegs on either side of the propeller as shown on some prior art for surface drive propellers.

Figure 15:
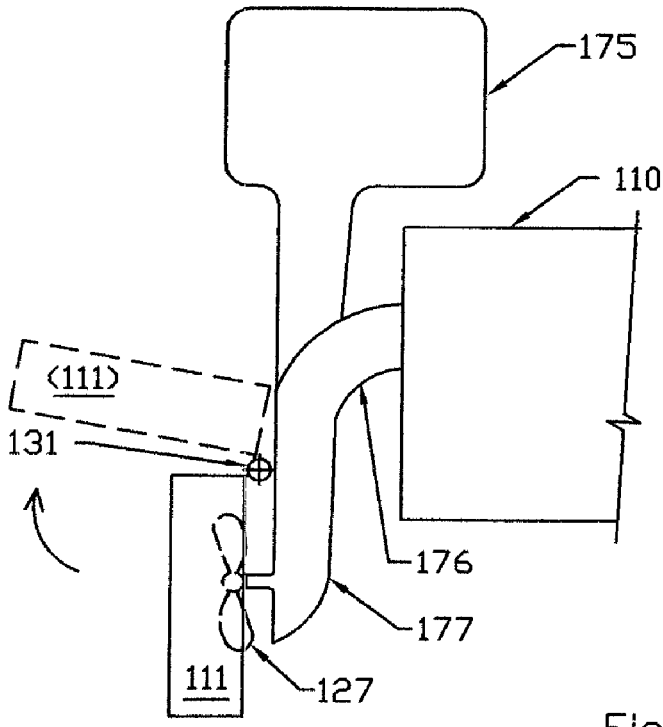
FIG. 15 is a side view of the rear portion of a boat with an outboard motor or alternatively with an inboard/outboard drive including a propeller according to another embodiment showing the thrust bucket in the deployed position as a solid line and in the retracted position as a dotted line similar to that of FIG. 4.

FIG. 15 is a side view similar to FIG. 4 showing a boat 110 with an outboard motor 175 or alternatively an inboard/outboard drive 176 with a thrust bucket 111 attached by a hinge 131 to the lower unit 177 of the propulsion system. When in the deployed position, the thrust bucket covers a portion of the propeller 127 and when in the retracted position the thrust bucket (111) is swung up and away from the propeller.

Figure 16:
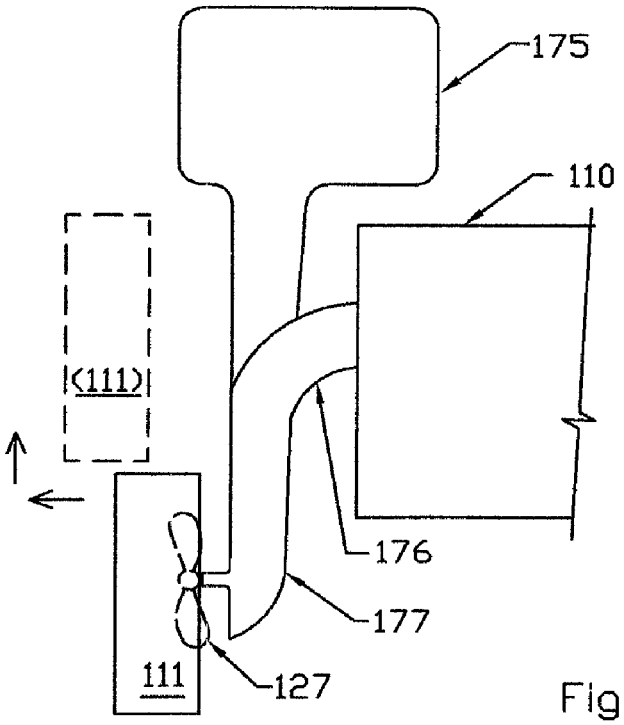
FIG. 16 is another embodiment similar to FIG. 15 of the rear portion of a boat with an outboard motor or alternatively with an inboard/outboard drive including a propeller and showing the thrust bucket in a deployed position as a solid line and in the retracted position as a dotted line.

FIG. 16 is a side view similar to FIG. 15 but shows a method for the thrust bucket 111 to be deployed and retracted similar to that shown in FIG. 6 or FIG. 10.

Figure 17:
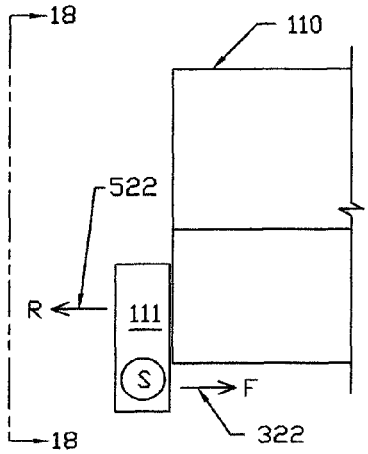
FIG. 17 is a side view of a rear portion of a boat according to another embodiment showing the thrust bucket in the deployed position.

FIG. 17 is side view of a boat 110 that is typical of a boat with a sloped bottom and twin propellers having one on either side of the longitudinal centerline of the boat. This figure shows the thrust bucket 111 is mounted vertical with respect to the horizon. The forward water jet 322 and the rearward water jet 522 are shown to pass clear of the hull. The thrust bucket can be retracted by any of the means shown in prior figures.

Figure 18:
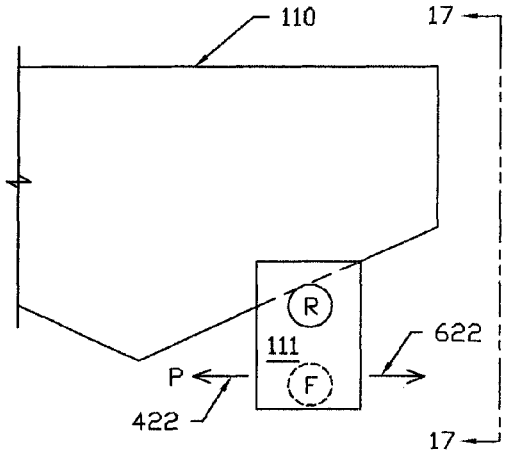
FIG. 18 is a rear end view of a boat as shown along Section line 18-18 of FIG. 17.

FIG. 18 is a rear end view of FIG. 17 and shows the starboard water jet 622 and the port water jet 422.

Figure 19:
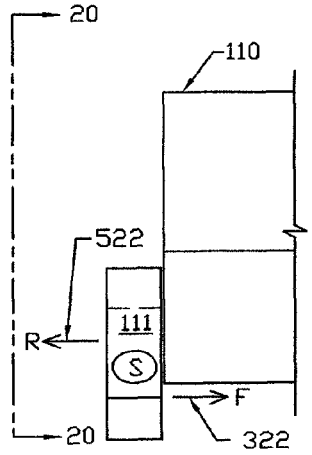
FIG. 19 is a side view of the rear portion of a boat according to another embodiment that is similar to that of FIG. 17 showing the thrust bucket in a deployed position in which it is tilted similar to the angle of the bottom of the boat.

FIG. 19 is a side view of a boat 110 similar to FIG. 17 but shows the thrust bucket 111 mounted at an angle generally perpendicular to the bottom slope of the boat. The forward water jet 322 and the rearward water jet 522 function as shown in FIG. 17.

Figure 20:
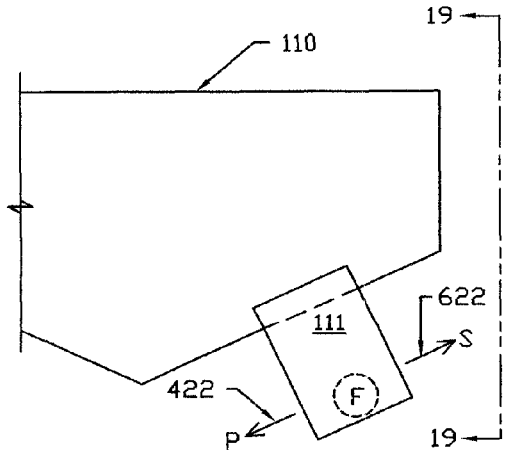
FIG. 20 is a rear end view of a boat as shown along Section line 20-20 of FIG. 19 showing the thrust bucket in a deployed position in which it is tilted similar to the angle of the bottom of the boat.

FIG. 20 is a rear end view of FIG. 19 and shows the thrust bucket 111 mounted generally perpendicular to the bottom of the boat 110. This mounting has the disadvantage of causing the water jets 622 and 422 to be directed in a non horizontal direction which decreases the force effectiveness of the water jet. However, it does have the advantage of directing the inboard water jet to not impact against the sister thrust bucket, not shown, but located towards the other side of the boat. This undesirable impact tends to nullify the side thrust effectiveness of either of the inboard directed water jets. General installation practice on boats with multiple thrust buckets would favor mounting each of the thrust buckets so that the water jets are angled slightly away from the sister thrust bucket. Of course, this can also be accomplished by slightly angling the nozzle direction of any of the water jets.

Figure 21:
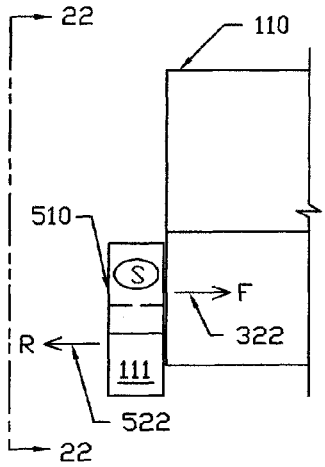
FIG. 21 is side view of the rear portion of a boat according to another embodiment similar to that of FIG. 19 and showing the thrust bucket in a deployed position, but with it tilted similar to the angle of the bottom of the boat, such that the long side of the thrust bucket is parallel to the bottom surface of the boat.

FIG. 21 is a side view of a boat similar to FIG. 19 and shows the forward water jet 322 and the rearward water jet 522.

Figure 22:
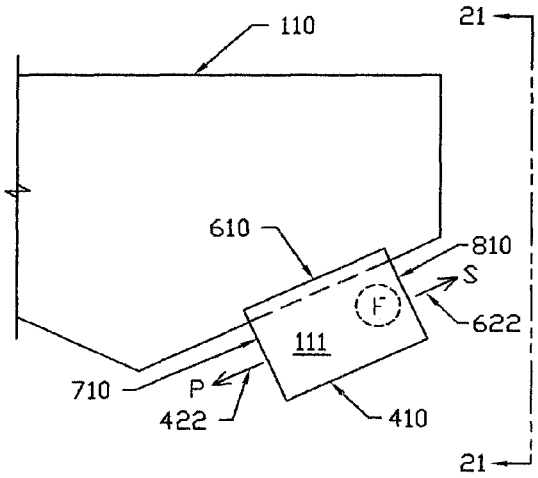
FIG. 22 is a rear end view of the rear portion a boat shown along Section line 22-22 of FIG. 21 and is similar to that of FIG. 20 but shows the thrust bucket rotated 90 degrees relative to that shown in FIG. 20. This arrangement may allow the boat to operate in very shallow water.

FIG. 22 is a rear end view of FIG. 21 and shows that the starboard water jet 622 is relocated to the top surface 810 of the thrust bucket 111, and the port water jet 422 is relocated to the bottom surface 710 of the thrust bucket. Thus, the side flow water valves are rotated 90 degrees relative to that shown in FIG. 20 and are generally parallel to the bottom of the boat 111. This arrangement allows for a shallower draft installation of the thrust bucket.

Figure 23:
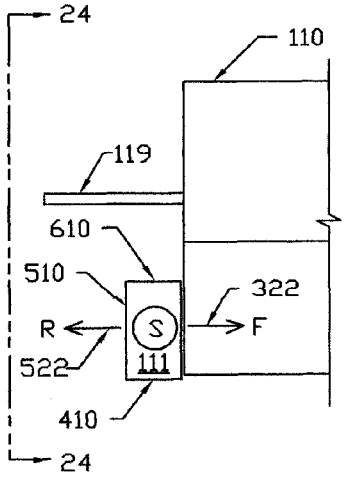
FIG. 23 is a side view of the rear portion of a boat similar to that of FIG. 21 but shows the thrust bucket rotated at 90 degrees relative to that shown in FIG. 17.

FIG. 23 is a side view of a boat similar to FIG. 21 with the thrust bucket 111 mounted below a swim platform 119 or other hull extension and shows the forward water jet 322 and the rearward water jet 522.

Figure 24:
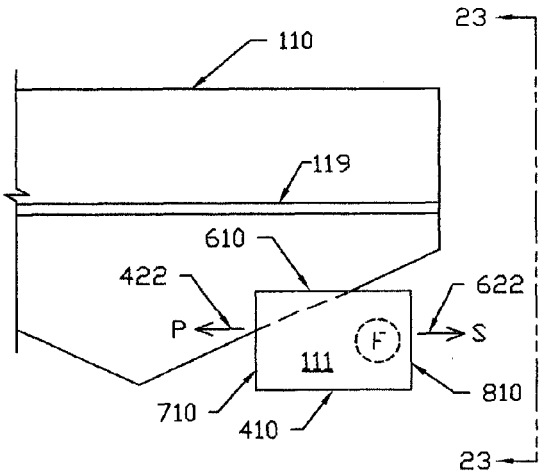
FIG. 24 is a rear end view of the rear end portion of the boat shown along Section line 24-24 of FIG. 23 and is similar to FIG. 18 but shows the thrust bucket rotated 90 degrees relative to that shown in FIG. 18. This arrangement may best accommodate the location of a thrust bucket under a swim platform or other similar hull extension.

FIG. 24 is a rear end view of FIG. 23 and shows that the starboard water jet 622 is relocated to the bottom surface 810 of the thrust bucket 111, and the port water jet 422 is relocated to the top surface 710 of the thrust bucket. This horizontal arrangement may lend itself to mounting the thrust bucket to the undersurface of a swim platform 119, and also provides a very shallow draft installation.

Figure 25:
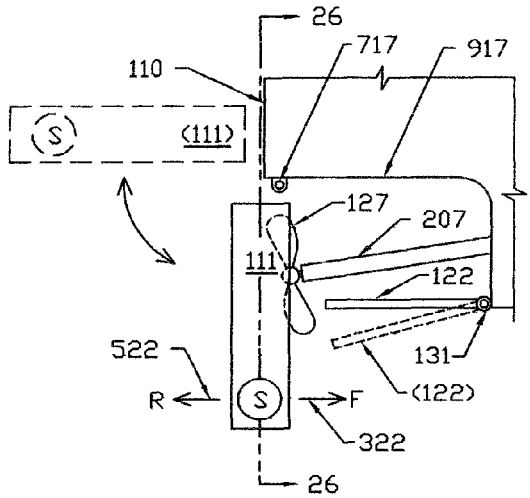
FIG. 25 is side view of a cross section of a rear portion of a boat that has a tunnel and a propeller located therein and shows a thrust bucket according to another embodiment in the deployed position as indicated by a solid line and a thrust bucket in a retracted position as indicated by a dotted line.

FIG. 25 is a cross section view of a boat 110 as viewed from the side wherein the boat has a propeller tunnel 917 with a propeller 127 mounted to a propeller shaft carrier 207 located within the tunnel. A hinge 131 is mounted at the forward end of the trim tab 122 to allow the trim tab to swing down below the bottom limits of the tunnel to allow water to spill around the edges and flow up into the propeller when operating at slow speed. Prior art shows a device similar to the trim tab 122 but only discloses it in a fixed position flush with the bottom surface of the boat and refers to it as a ground wall and is intended to limit flooding of the propeller 127 at high speeds. Other prior art shows a hinged trim tab likewise flush with the bottom of the boat that can swing up into the tunnel, but cannot extend down below the bottom surface of the boat. This feature exceeds prior art by allowing the trim tab 122 to swing downward below the bottom of the boat to allow water to spill around the edges of the trim tab and flow up into the tunnel and into the propeller. The dotted line image of the trim tab (122) shows it in the lowered and open position to allow water to flow up into the tunnel. The trim tab is moved up or down by a remotely controlled actuator, such as, for example a force ram or cables (not shown). A thrust bucket 111 similar to FIG. 2 is connected to the boat by a hinge 717 to allow the thrust bucket to be in the deployed position around the propeller, or to swing up to the retracted position (111). The propeller located in the tunnel in FIG. 25 is typical of, but not limited to, some prior art high speed boats with surface piercing propellers in which only a lower portion of the propeller is immersed in the water at high speed.

Figure 26:
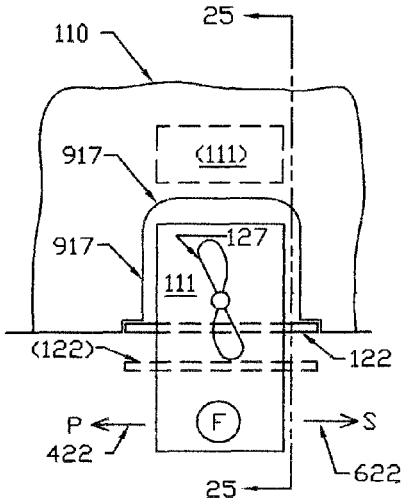
FIG. 26 is rear end section view of a portion of a rear end of a boat with a tunnel in the bottom of the hull and a propeller located therein looking along Section line 26-26 of FIG. 25 but gratuitously showing the thrust bucket in the retracted position as a dotted line.

FIG. 26 is a rear end view of FIG. 25 and shows the side walls and top wall of the propeller tunnel 917 and shows how trim tab 122 normally rests against the bottom of the tunnel, but how it can be swung down, as shown as dotted lines and noted as (122), to allow water to spill around the edges and flow up into the propeller 127 when operating at slow speed. Starboard water jet 622 and port water jet 422 are shown.

Figure 27:
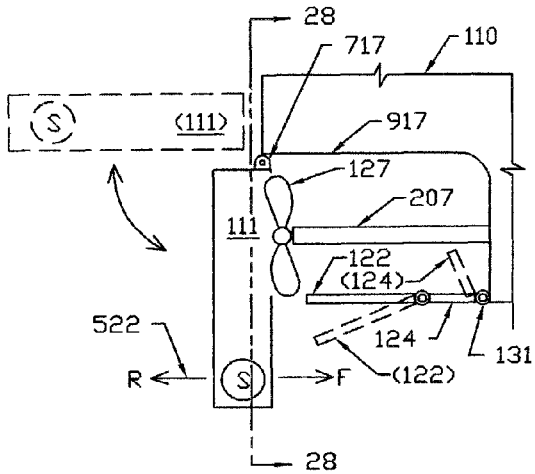
FIG. 27 is a side view of a cross section of a boat and propeller system including a thrust bucket according to another embodiment very similar to that of FIG. 25 but including a means to admit water to the tunnel through a trap door adjacent to a prior art tunnel closure plate. In this case the thrust bucket in the deployed position is shown as a solid line and in the retracted position is shown as a dotted line.

FIG. 27 is a cross section view of a boat 110 similar to FIG. 25 with a trim tab 122 on the bottom of the tunnel 917. As disclosed in FIG. 25, a hinge 131 at the front end of trim tab 122 allows the trim tab to swing down away from the tunnel to allow water to flow up into the tunnel when operating at a slow speed and to control the depth of propeller blade immersion when operating at high speed. This feature further exceeds prior art by adding a trap door 124 as a continuation of the bottom surface of the boat and is located ahead of trim tab 122, or ground wall of prior art. The trap door is opened to allow water to flow up into the propeller tunnel when operating at low speed and is closed when the boat is operating at high speed. Trap door 124 is connected to the boat by a hinge 131 similar to that of FIG. 25, but the trap door may be constructed as a sliding gate valve to be opened in a sliding action or by any other means of construction to allow water to flow up into the tunnel. The dotted line image of the trap door (124) shows it in an open position. An alternate construction allows the trap door to be built into the trim tab or ground wall as a part of that assembly. The trap door is opened and closed by a remotely controlled actuator, for example a force ram or cables, not shown. The thrust bucket 111 can be raised to the retracted position (111) by hinge 717 or other means such as guide rails as discussed before. The propeller 127 located in the tunnel in FIG. 27 is typical of, but not limited to, some prior art high speed boats with surface piercing propellers in which only a lower portion of the propeller is immersed in the water at high speed.

Figure 28:
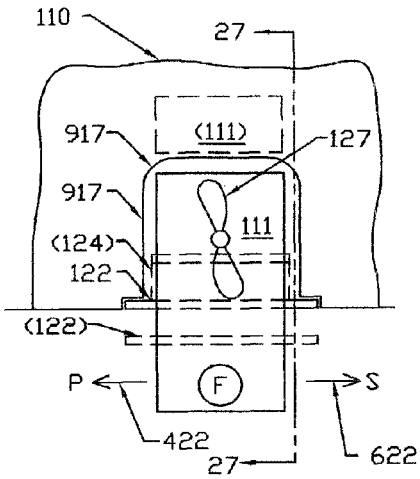
FIG. 28 is a rear end section view of a portion of a rear end of a boat with a tunnel in the bottom of the boat hull and a propeller located therein looking along Section line 28-28 of FIG. 27 but gratuitously showing the thrust bucket in the retracted position as a dotted line.

FIG. 28 is a rear end view of FIG. 27 and shows trap door (124) as dotted lines, in the open position. The trap door can be opened or closed by a force ram, or other means, not shown in this figure. Starboard water jet 622 and port water jet 422 are shown.

Figure 29:
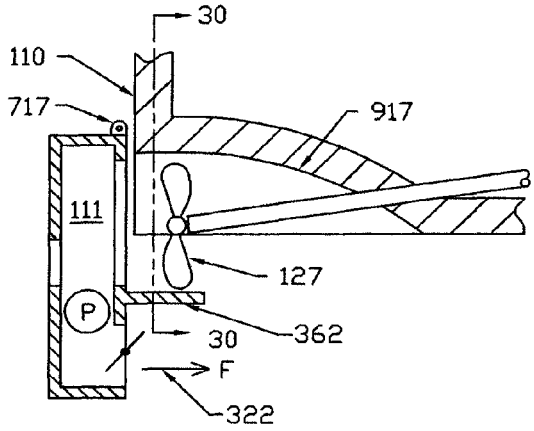
FIG. 29 is a side view of a cross section of the rear end of a boat with a propeller and includes a thrust bucket according to another embodiment in a deployed position similar to that of FIG. 25. The thrust bucket is shown as a crosshatched line and further includes a forward extension that resides under the sweep of the propeller blade tips.

FIG. 29 is a cross section view of a side of a boat 110 that has a propeller 127 partially recessed in a streamlined tunnel 927 formed into the bottom of the hull and is typical of cruiser yachts that have normal full immersion propellers. Thrust bucket 111 is shown in the deployed position and includes a lower arc 362 that, when taken together with the top portion of the tunnel, forms part of a total annulus around the propeller 127. Hinge 717 allows the thrust bucket to swing up and away from the propeller when in the retracted position.

Figure 30:
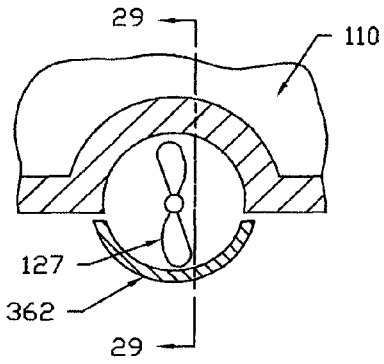
FIG. 30 is a rear end section view of a portion of a rear end of a boat looking along Section line 30-30 of FIG. 29 with a tunnel in the bottom of the boat hull and a propeller located therein in a tunnel that is semicircular in cross section to form a close fitting shroud over the top of the propeller.

FIG. 30 is a rear end view of FIG. 29 along Section line 29-29 and shows the lower arc 362 that is part of the thrust bucket 111 as discussed in FIG. 29.

Figure 31:
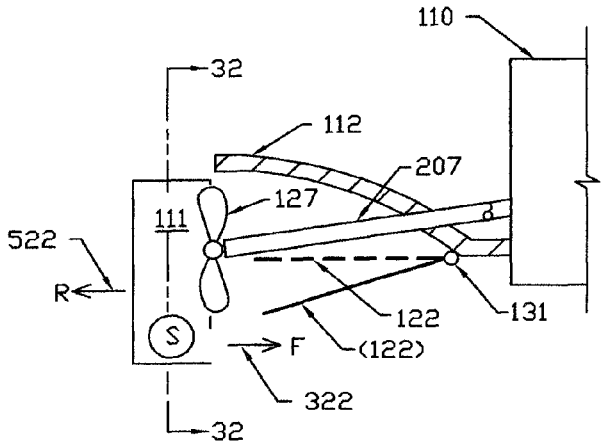
FIG. 31 is a side view of a cross section of a type of prior art propeller drive that extends beyond the transom of the boat and is manufactured with a close fitting semicircular shroud over the propeller and shows the thrust bucket in the deployed position. Section line 32-32 shows the view in FIG. 32.

FIG. 31 is a cross section view of a type of prior art external propeller drive that has a full length tapered tunnel 112 that is made to mount to the propeller shaft carrier 207. In some prior art applications the tapered tunnel and the propeller shaft carrier are mounted to the boat to allow left and right steering motions and up and down trim motions of both devices as a connected unit. This feature exceeds prior art by the addition of a trim tab 122 connected to the tapered tunnel by hinge 131 to allow the trim tab to move up or down to control the amount of water flowing into the propeller 127. In this embodiment the thrust bucket 111 is connected to the tapered tunnel to allow the thrust bucket to swing up to the retracted position. The propeller arrangement and tapered tunnel in FIG. 31 is typical of, but not limited to, some prior art surface piercing propeller drive propulsion systems wherein only a portion of the propeller is immersed in the water at high speeds. The trim tab 122 is shown with dotted lines in the raised position and with solid lines at (122) in the lowered position.

Figure 32:
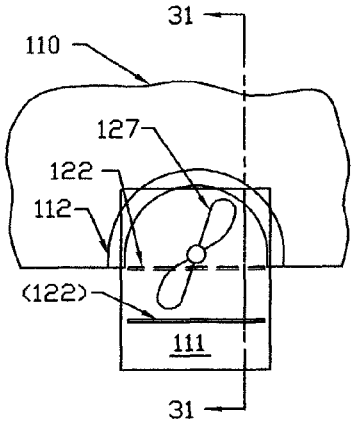
FIG. 32 is a rear end view of a section of a portion of a rear end of a boat with a prior art propeller drive of FIG. 31 looking along Section line 32-32 of FIG. 31. Note that FIG. 32 does not show the intended annulus of the thrust bucket in an attempt to minimize clutter on the drawing. Section line 31-31 shows the view in FIG. 31.

FIG. 32 is a rear end cross section view of FIG. 31 at Section line 32-32 and shows thrust bucket 111 in the deployed position and shows the trim tab 122 in the lowered position at (122) with a solid line and in the raised position 122 (dashed lines) to allow water to flow around the edges of the trim tab and up into the propeller 127 when the boat is operating at low speeds.

Figure 33:
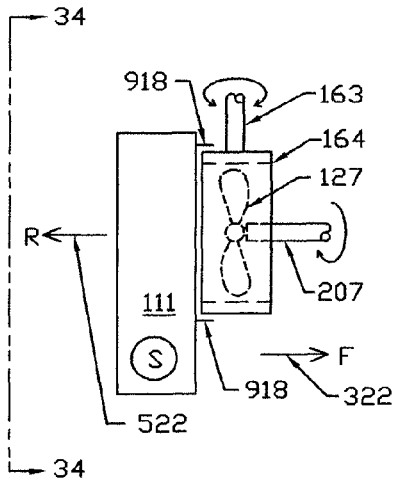
FIG. 33 is side view of a propeller with a Kitchen style rudder surrounding the propeller and shows a thrust bucket according to another embodiment in a deployed position and shows the close fit of the thrust bucket to the Kitchen rudder to generate an annulus around the propeller blade tips.

FIG. 33 is a side view of a propeller 127 surrounded by a cylindrical shroud that is typical of very old prior art known as a Kitchen rudder 164. Usually the Kitchen rudder turns about rudder shaft 163, but is not necessary for the use of the thrust bucket 111. When in use with the thrust bucket, the Kitchen rudder must be turned to the straight ahead steering position to have the rearward face of the rudder to align parallel to the forward face of the thrust bucket 111. This alignment allows the thrust bucket to rest close against the rear edge of the rudder to form a reasonably tight seal. The Kitchen rudder forms the annulus around the propeller but the forward face of the thrust bucket must be pressed against the rearward face of the Kitchen rudder in order for the annulus to be effective in pressurizing water in the thrust bucket. The thrust bucket can be retracted by any of the means previously discussed. Kitchen rudders are typically not used on high speed boats because of the high drag force of the rudder.

Figure 34:
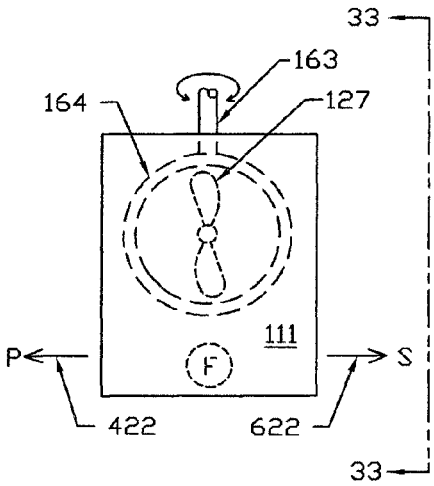
FIG. 34 is a rear end view of a kitchen style rudder and thrust bucket looking along Section line 34-34 of FIG. 33. The annulus around the propeller is not shown, but matches the rudder shroud around the propeller.

FIG. 34 is a rear end view of FIG. 33 and shows the cylindrical shape of the Kitchen rudder 164 that surrounds the propeller 127.

Figure 35:
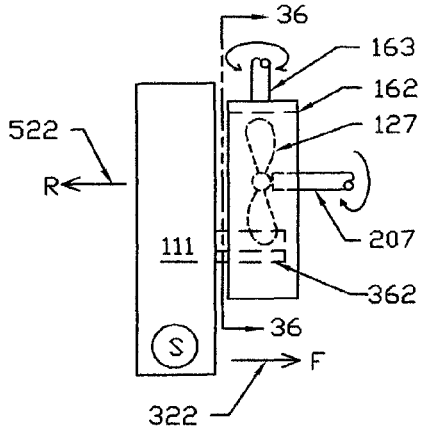
FIG. 35 is a side view of propeller with a partial arc Kitchen style rudder that is open on the bottom but partially surrounds the propeller and shows the thrust bucket in the deployed position.

FIG. 35 is a side view of a propeller 127 surrounded by a type of prior art known as a partial kitchen rudder 162 that has a cylindrical top and straight sides pointed downward. Partial arc shroud 362 acts a closure strip to make the open rudder perform like the Kitchen rudder of FIG. 33. Thrust bucket 111 is pressed against the rearward face of the partial kitchen rudder to allow the water to be forced into the thrust bucket.

Figure 36:
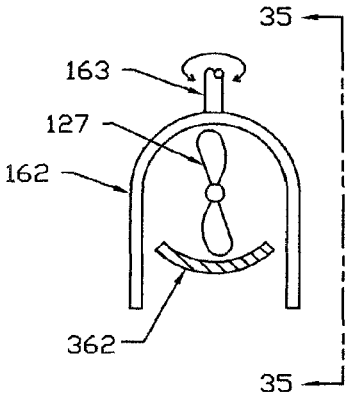
FIG. 36 is a rear end view of the partial arc Kitchen rudder of FIG. 35 showing the partial arc of the thrust bucket underneath the propeller that forms the annulus around the propeller when matched to the curved upper portion of the rudder.

FIG. 36 is a rear end view of FIG. 35 along Section line 36-36 and shows partial arc shroud 362 as a part of the thrust bucket 111 that fits below the propeller 127 and into the partial kitchen rudder 162.

Figure 37:
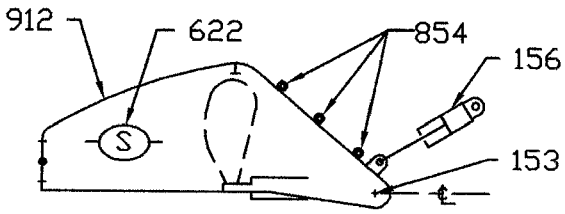
FIG. 37 is a side view of a fragmentary view of the upper jaw of a two piece thrust bucket according to another embodiment showing the upper half of the propeller as a hidden line inside of the upper jaw.
Figure 39:
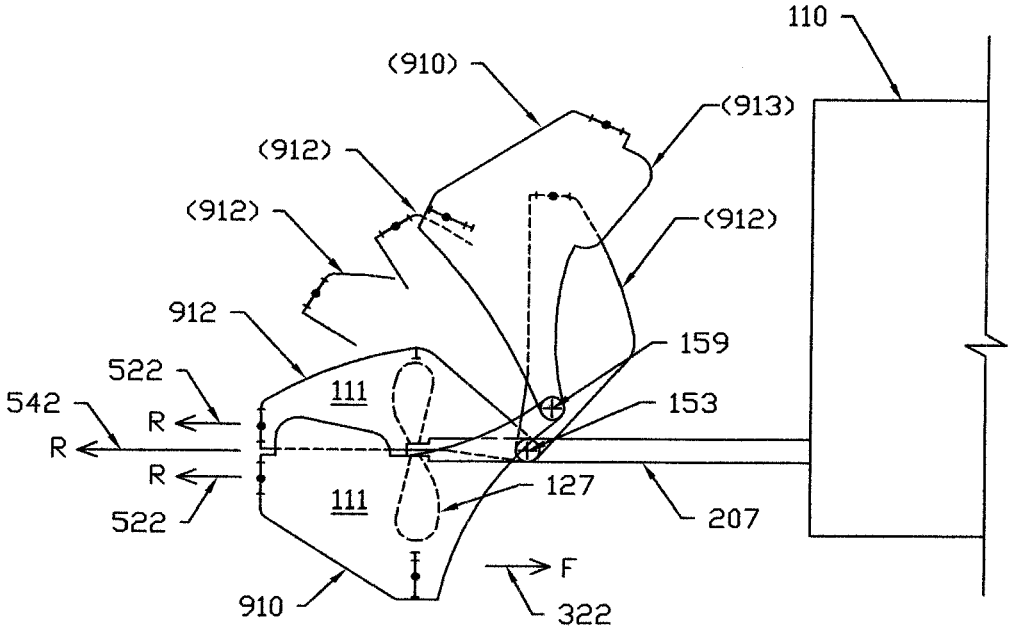
FIG. 39 is a side view of rear portion of a boat with a propeller and having a propeller shaft carrier attached to the boat and includes a two piece thrust bucket according to the embodiments shown in FIGS. 37 and 38 together. The two piece thrust bucket is comprised of the upper jaw of FIG. 37 and the lower jaw of FIG. 38 as in the deployed position around the propeller and further shows how the two jaws are progressively raised and nested in the retracted position as indicated by the item numbers in parentheses.

FIG. 37 is a side view of an upper jaw 912 for a two piece thrust bucket 111 that is shown as an assembly in FIG. 39. As used herein, each "jaw" is a piece or section forming a plenum wall of the plenum of a thrust bucket. In various embodiments, the plenum includes several retractable jaws that are moved between a retracted or inoperative position and a deployed or operative position. In various embodiments the retractable plenum walls nest together when in the retracted position. The upper jaw has a screen 854 to prevent objects from falling into the propeller, and has a force ram 156 for retracting and deploying the upper jaw around the propeller, and is connected indirectly to the propeller shaft carrier 207, not shown, by hinge pin 153. Starboard water jet 622 is shown.

Figure 38:
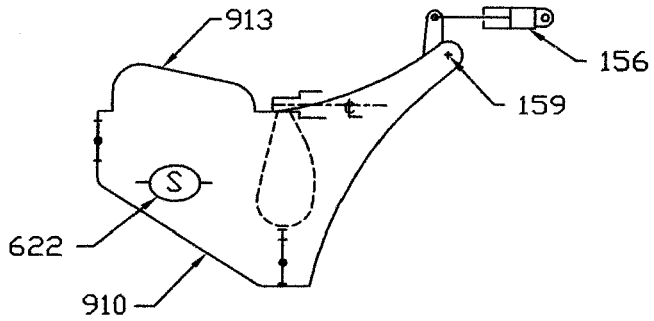
FIG. 38 is a side view of a fragmentary view of the lower jaw of a two piece thrust bucket of FIG. 37 showing the lower half of the propeller as a hidden line inside of the lower jaw.

FIG. 38 is a side view of a lower jaw 910 for a two piece thrust bucket 111 that is shown as an assembly in FIG. 39. The lower jaw has a forcing ram 156 for retracting and deploying the lower jaw around the propeller, and is connected indirectly to the propeller shaft carrier 207, not shown, by hinge pin 159. The lower jaw has a pair of cheeks 913, one on either side of the jaw.

FIG. 39 is a side view of both upper jaw 912 and lower jaw 910 closed around propeller 127. Also shown is a sequence of the upper jaw and the lower jaw being opened and retracted upward away from the propeller 127. The upper jaw opens fully before the lower jaw opens to the fully raised position. The partially open and fully open positions are noted as item numbers contained in parentheses. The annulus of the lower jaw has sufficient clearance to clear the blade tips of the propeller and usually is placed near the back edge of the propeller. Although this propeller appears to be a round ear style, these high speed propellers usually are a cleaver style that has a very distinct plane at the rear of the propeller blades at the point of maximum diameter of the propeller. A rearward water jet 522 is shown in both the upper jaw and lower jaw. Also, the upper jaw can be opened slightly to emit a stream of water rearward to also function as a rearward water jet 542. The cheeks 913 on the lower jaw prevent water from escaping out the side of the thrust bucket when using the open jaw technique for emitting a rearward water jet. This arrangement is particularly suited for extended shaft type surface drives as indicated by the long propeller shaft carrier 207 extending rearward from the boat 110.

Figure 40:
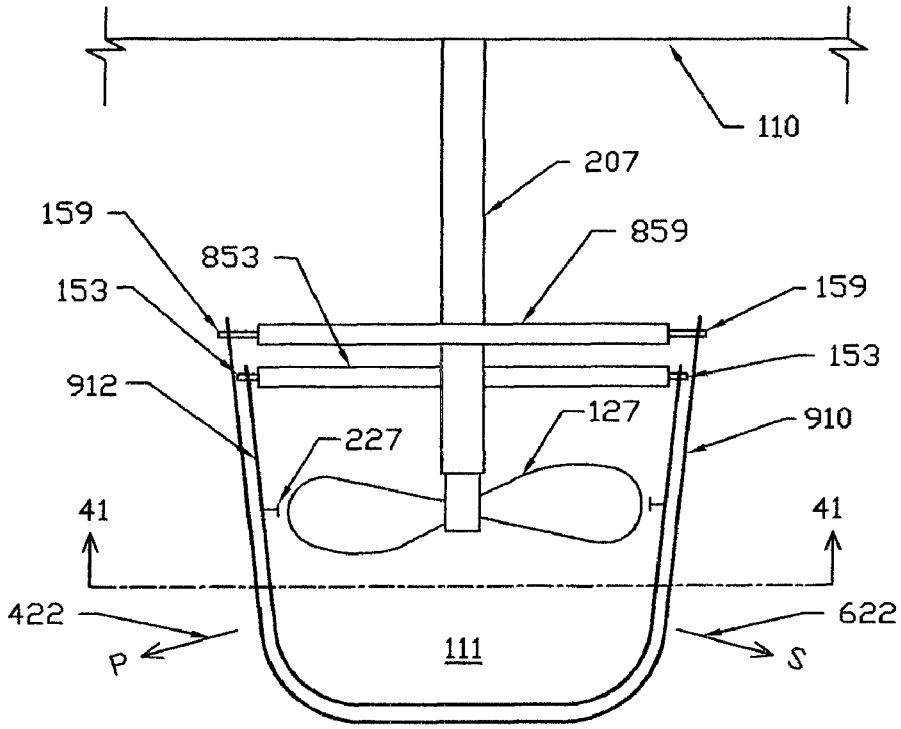
FIG. 40 is a top sectional view of the two piece thrust bucket of FIG. 39 in the deployed position showing the rear end of the boat and the propeller attached to the propeller shaft carrier.
Figure 41:
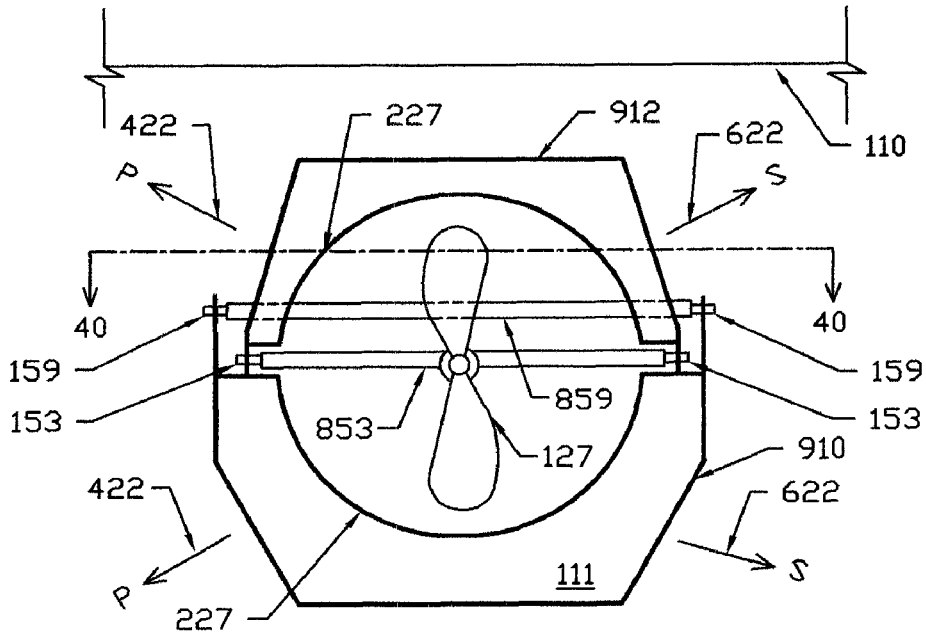
FIG. 41 is a rear end view looking along Section line 41-41 of FIG. 40 showing a portion of the rear of a boat with a propeller and the upper jaw and lower jaw of a two piece thrust bucket in the deployed position. The annulus is shown as a two piece circle surrounding the propeller blade tips.

FIG. 40 is a top section view of FIG. 39 taken along Section line 40-40 in FIG. 41 and shows the propeller shaft carrier 207 and a propeller 127 surrounded by the thrust bucket comprised of the lower jaw 910 and the upper jaw 912. Lower jaw 910 is mounted by pivot pins 159 to jaw bracket 859 and upper jaw 912 is mounted by pivot pins 153 to jaw bracket 853. Annulus 227 is shown surrounding the propeller. Starboard water jet 622 and port water jet 422 are shown to have a slight rearward direction that may be advantageous to prevent the water jets from impinging on the adjacent thrust bucket when used on boats with multiple propellers.

FIG. 41 is a rear section view of FIG. 39 taken along Section line 41-41 in FIG. 40 and shows propeller 127 located centrally within the circle of annulus 227 comprised of a lower half circle in lower jaw 910 and upper half circle in upper jaw 912. Starboard water jet 622 and port water jet 422 can be located in either the upper jaw or lower jaw or both.

Figure 42:
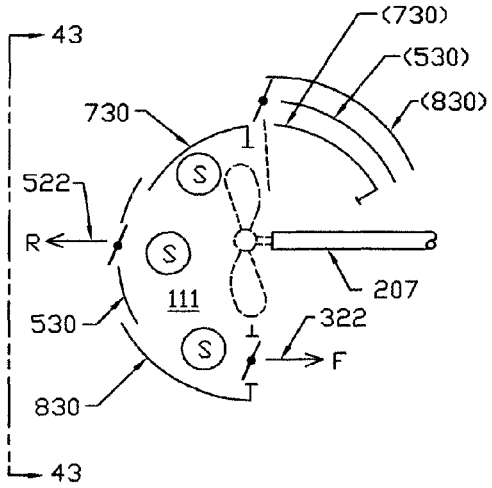
FIG. 42 is a sectional side view of a propeller and a propeller shaft carrier including a three piece thrust bucket according to another embodiment showing three jaws deployed around the propeller and also with the three jaws retracted in a nested fashion above and away from the propeller with the respective item numbers enclosed in parentheses.

FIG. 42 is a side view of a three piece thrust bucket 111 comprising an upper jaw 730, a middle jaw 530, and a lower jaw 830, wherein each jaw has a progressively larger radius to allow the jaws to nest together when in the retracted position, as indicated by parentheses, yet allows them to open to a generally hemispherical or semi cylindrical shape when deployed around the propeller. Forward water jet 322 and rearward water jet 522 are similar to prior examples.

Figure 43:
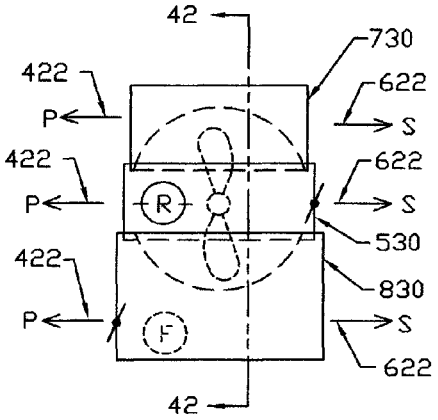
FIG. 43 is a rear end view of a three piece thrust bucket looking along Section line 43-43 of FIG. 42.

FIG. 43 is a rear end view of FIG. 42 taken along Section line 43-43 in FIG. 42 and shows the three jaws comprising an upper jaw 730, a middle jaw 530, and a lower jaw 830 wherein each jaw has a progressively greater width to allow the jaws to nest together when in the retracted position, as indicated by parentheses, yet allows them to open to a generally hemispherical or semi cylindrical shape when deployed around the propeller. Starboard water jet 622 and port water jet 422 can be mounted in the side of any of the jaw sections.

Figure 44:
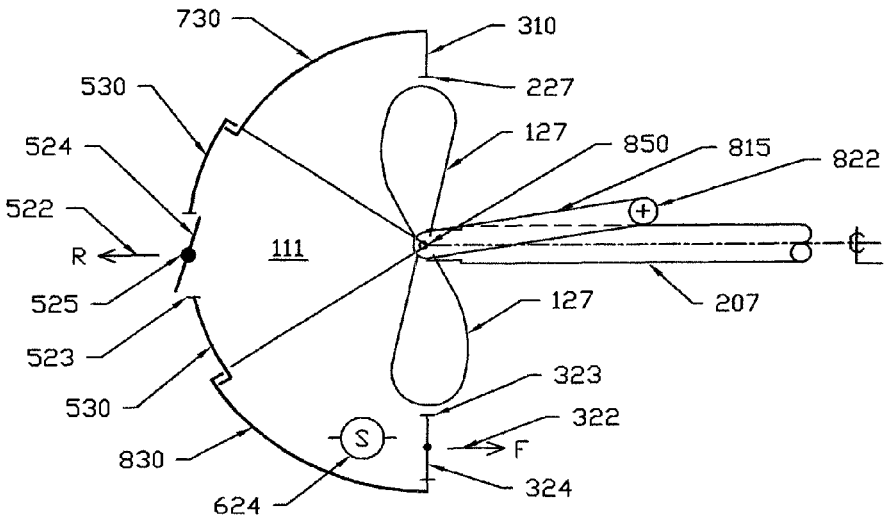
FIG. 44 is an enlarged side view of a three piece thrust bucket embodiment similar to FIG. 42 shown in the deployed position, but shows greater detail of how the thrust bucket sections are mounted to the propeller shaft carrier.
Figure 50:
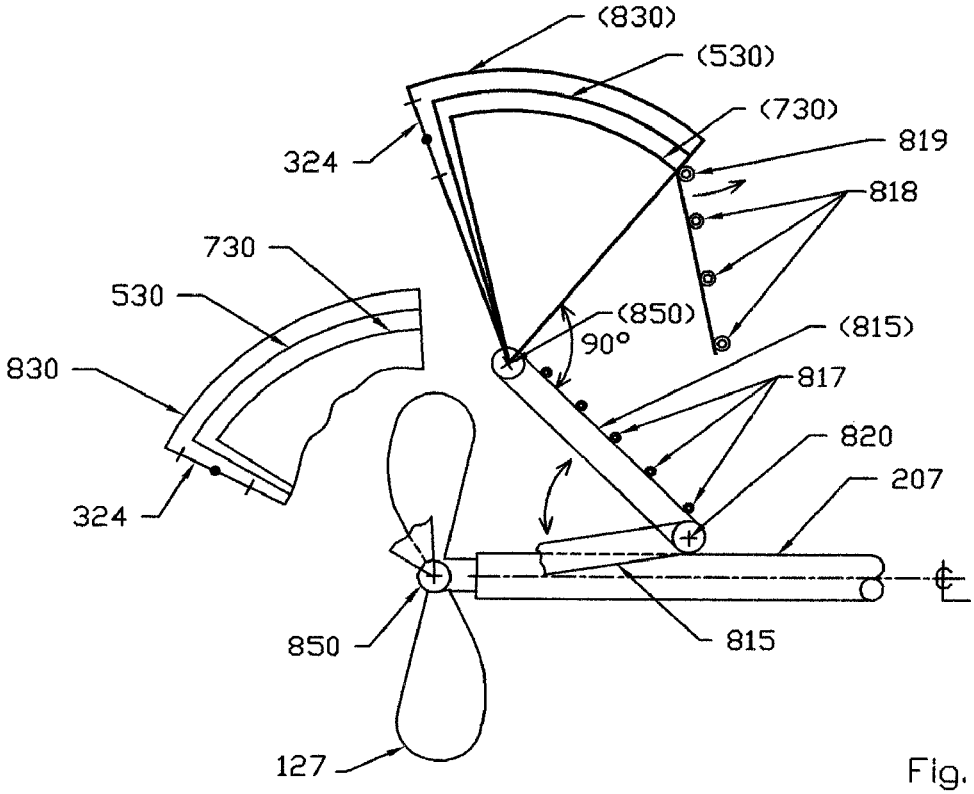
FIG. 50 is a side sectional view of another embodiment similar to FIG. 47 showing how the nested thrust bucket sections can be progressively raised up and away from the propeller by means of a separate bracket, similar to that shown in FIG. 44, which hinges about the propeller shaft carrier.

FIG. 44 is a more detailed version of FIG. 42 and shows how the jaws have an interlocking lip between adjacent surfaces to minimize leakage and to assist in holding alignment when deployed. Each of the three jaws pivots about a pivot pin 850 at a common point close to the transverse axis of the propeller 127. It is noted that the jaws of FIG. 42 reside in a location slightly forward of the propeller and above the propeller shaft carrier 207. On fully submerged propellers, this would be unacceptable and is only partially acceptable on surface piercing propellers because the surface piercing propellers require a large quantity of air to flow into the propeller on the upper half of the propeller. Therefore, this problem is solved by the use of a pair of bucket assembly swing arms 815, one of each located and attached on either side of the thrust bucket by hinge pins 850 and connected to the propeller shaft carrier 207 at a hinge 822. FIG. 50 shows how the nested thrust bucket jaws are withdrawn away from the propeller inlet area.

Figure 45:
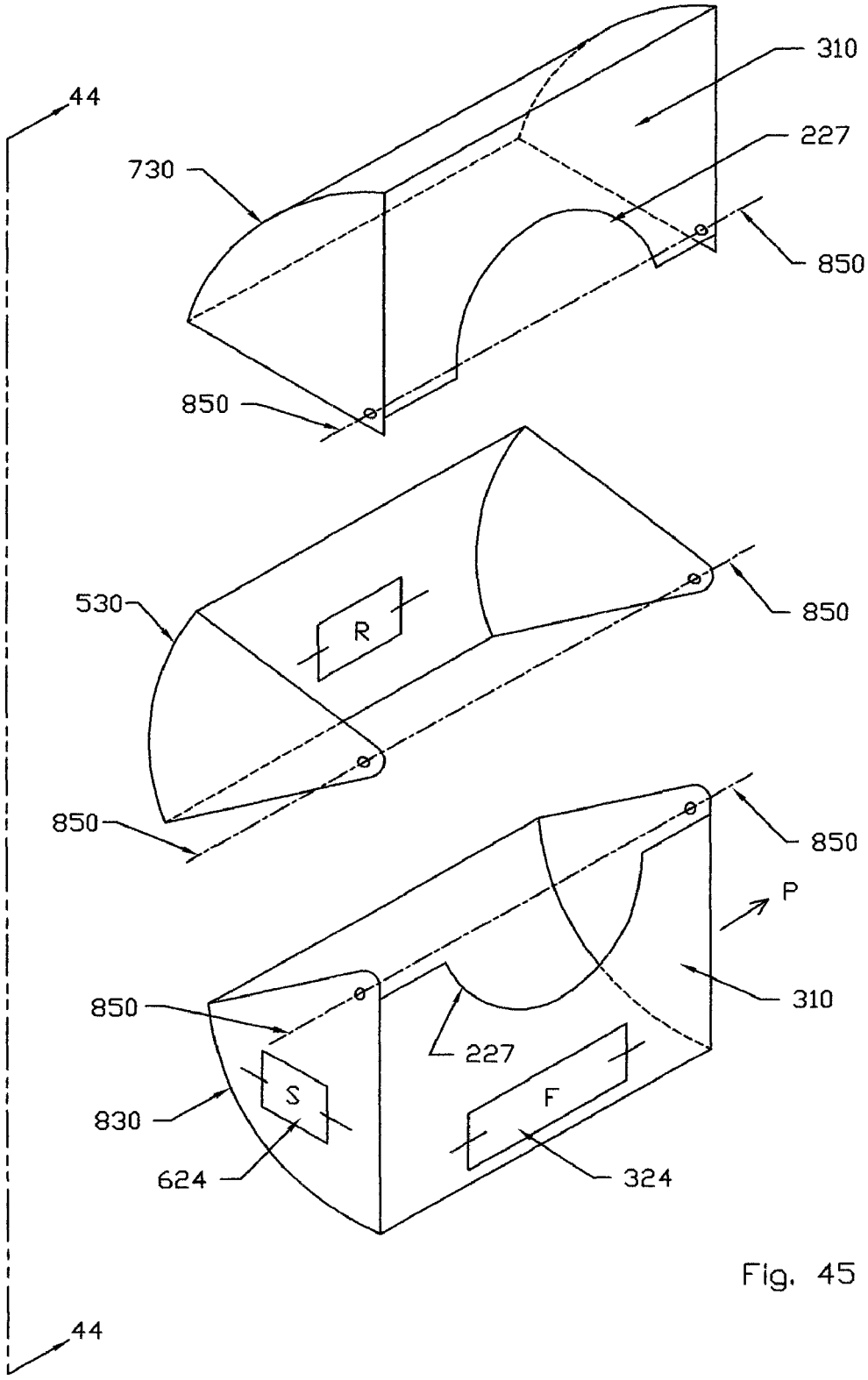
FIG. 45 is an exploded diagram of a perspective view of the thrust bucket of FIG. 44 showing the upper portion, the middle portion, and the lower portion as separate pieces.

FIG. 45 is an exploded view of the three thrust bucket jaws of FIG. 44 comprised of upper jaw 730, middle jaw 530, and lower jaw 830 and shows the axis of rotation of each jaw around pivot pin 850.

Figure 46:
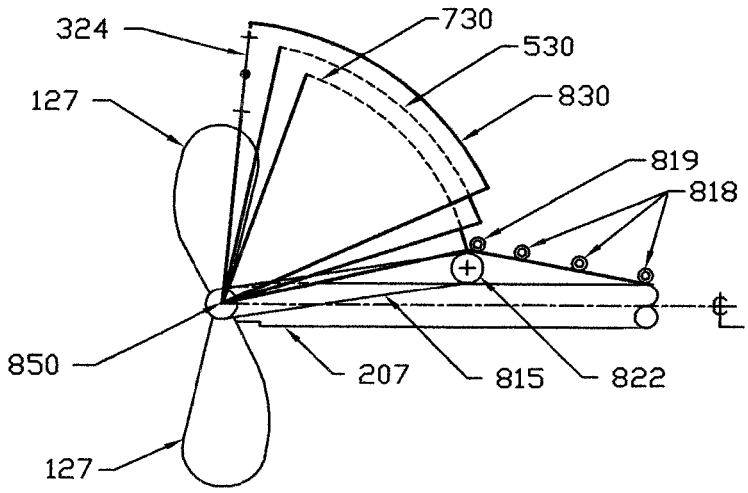
FIG. 46 is another side view of the thrust bucket of FIG. 44 showing the three separate jaws of the thrust bucket as retracted away from the propeller and also showing a trash screen to keep object from entering the propeller.

FIG. 46 is a view similar to FIG. 44 and shows the thrust bucket jaws partially retracted as shown in FIG. 42. An inlet screen 818 comprised of wires, or the like, is connected to upper jaw 730 by hinge 819.

Figure 47:
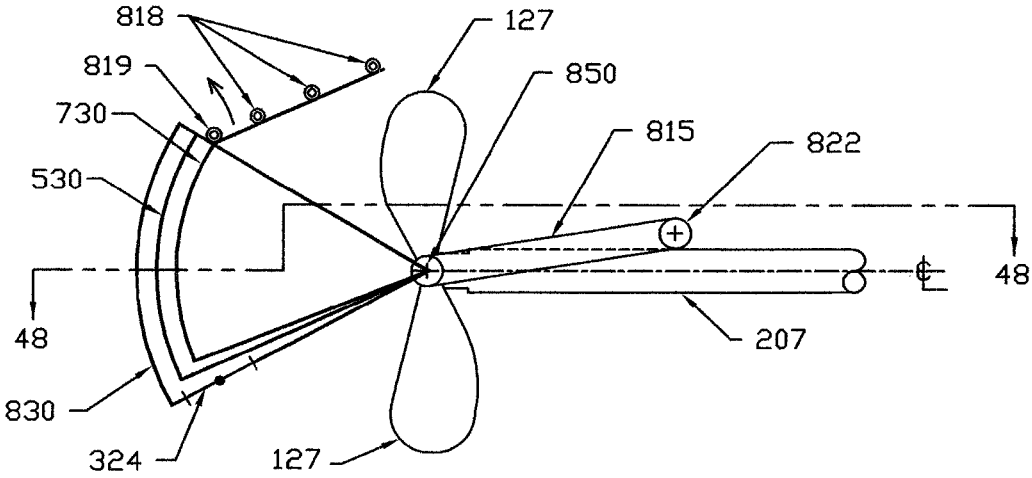
FIG. 47 is another side view of the thrust bucket and propeller similar to FIG. 46 showing how the three jaws nest together rearward of the propeller. The respective pieces are shown rotated to the same horizontal position to illustrate relative nesting position, but which is not a normal operating position.
Figure 48:
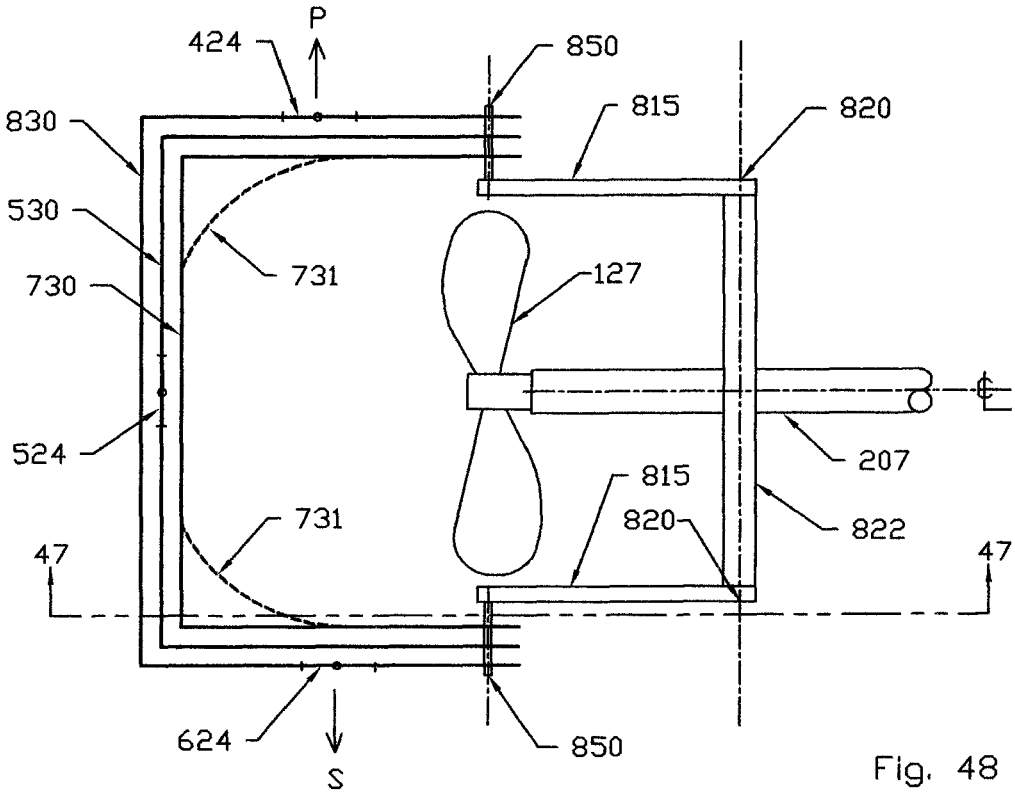
FIG. 48 is a top sectional view of a three piece thrust bucket nested together as viewed looking along Section line 48-48 of FIG. 47. The respective pieces are shown rotated to the same horizontal position to illustrate relative nesting position, but which is not a normal operating position.

FIG. 47 is a view similar to FIG. 46 and shows the thrust bucket jaws nested together to help envision FIG. 48. The respective pieces are shown rotated to the same horizontal position to illustrate relative nesting position, but which is not a normal operating position.

FIG. 48 is a top view of FIG. 47 taken along Section line 48-48 and shows how each of three jaws, including an upper jaw 730, a middle jaw 530, and a lower jaw 830, of the thrust bucket nest together when in the collapsed mode. The respective pieces are shown rotated to the same horizontal position to illustrate relative nesting position, but which is not a normal operating position.

Figure 49:
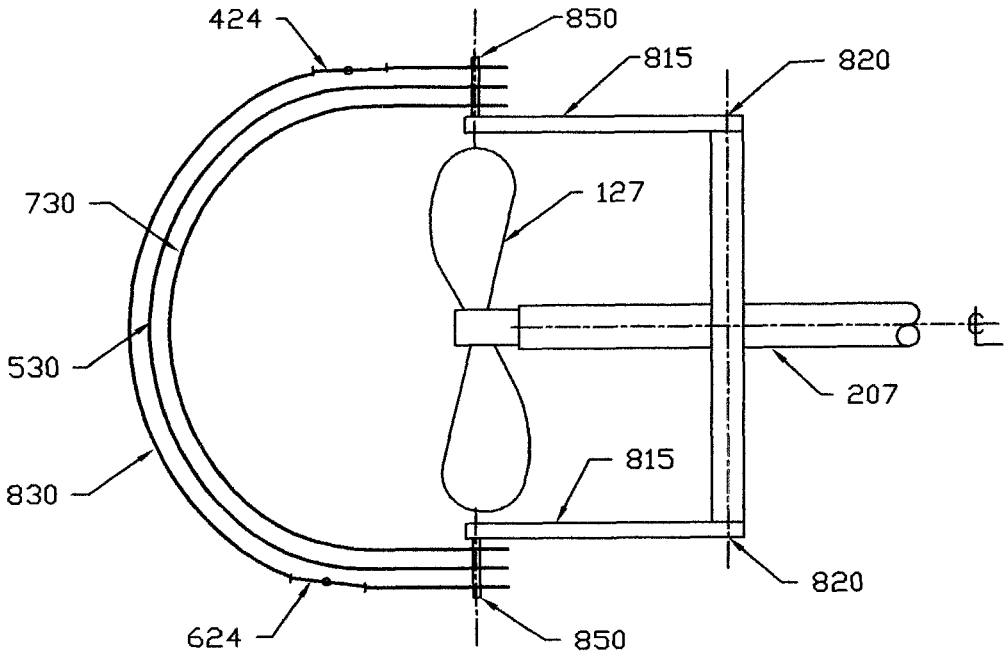
FIG. 49 is a top sectional view of a three piece thrust bucket nested together according to another embodiment that is very similar to FIG. 47 and FIG. 48 but with the bucket jaws more spherical rather than cylindrical. The respective pieces are shown rotated to the same horizontal position to illustrate relative nesting position, but which is not a normal operating position.

FIG. 49 is similar to FIG. 48 and shows how the thrust bucket jaws, including the upper jaw 730, the middle jaw 530, and the lower jaw 830, can be made as portions of a sphere that resemble longitudinal orange peels yet still nest together as desired. The respective pieces are shown rotated to the same horizontal position to illustrate relative nesting position, but which is not a normal operating position.

FIG. 50 is similar to FIG. 46 and shows how the thrust bucket jaws comprised of upper jaw 730, middle jaw 530, and lower jaw 830 can be raised up by means of swing arms 815 that pivot around hinge pin 820 to move the entire assembly up and away from the inlet to propeller 127. Inlet screen 817, comprised of wires or the like, is mounted to swing arms 815 to prevent objects from entering the propeller. The inlet screen is similar to inlet screen 818 in FIG. 46.

Figure 51:
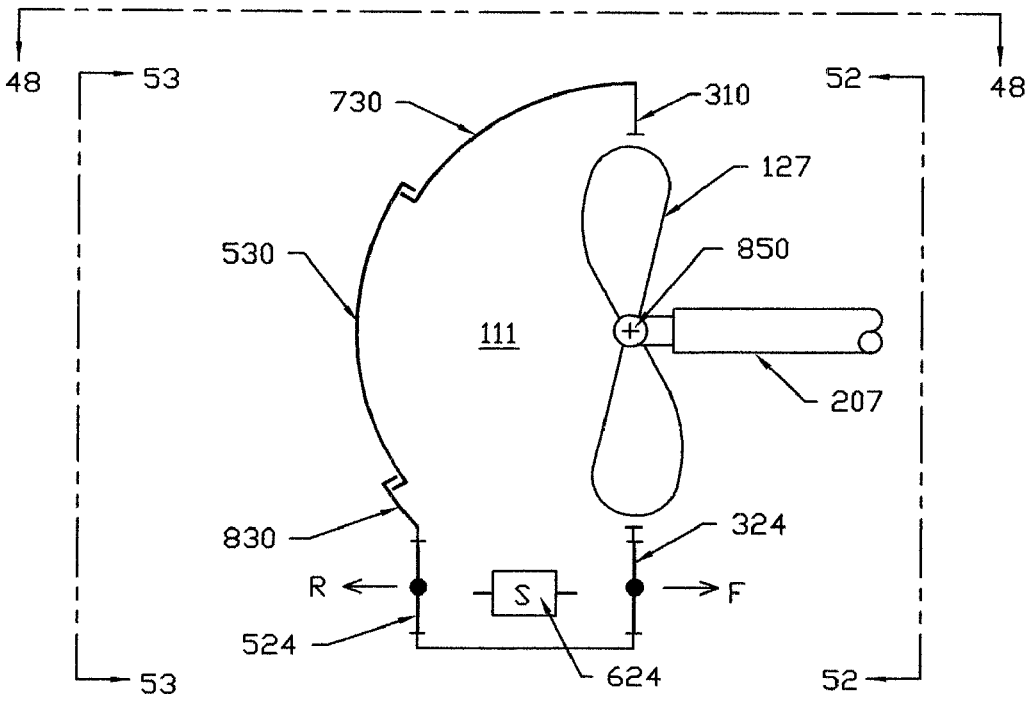
FIG. 51 is a sectional side view of a three piece thrust bucket according to another embodiment in a deployed position around a propeller similar to that of FIG. 44 but with different details for the water flow valves. Section line 48-48 is a top view of the thrust bucket as shown in FIG. 48. Section line 52-52 is a front end view where the water enters the propeller as shown in FIG. 52.

FIG. 51 is similar to FIG. 44 but shows the water jets mounted in the lower jaw 830 and is accomplished by adding a small box like extension to lower jaw 830 to accommodate the forward water flow valve 324, the rearward water flow valve 524, the starboard water flow valve 624, and the port water flow valve 424 which is not shown. This facilitates simpler and stiffer construction of the middle jaw 530 in particular because there is no water jet or valves in that jaw.

Figure 52:
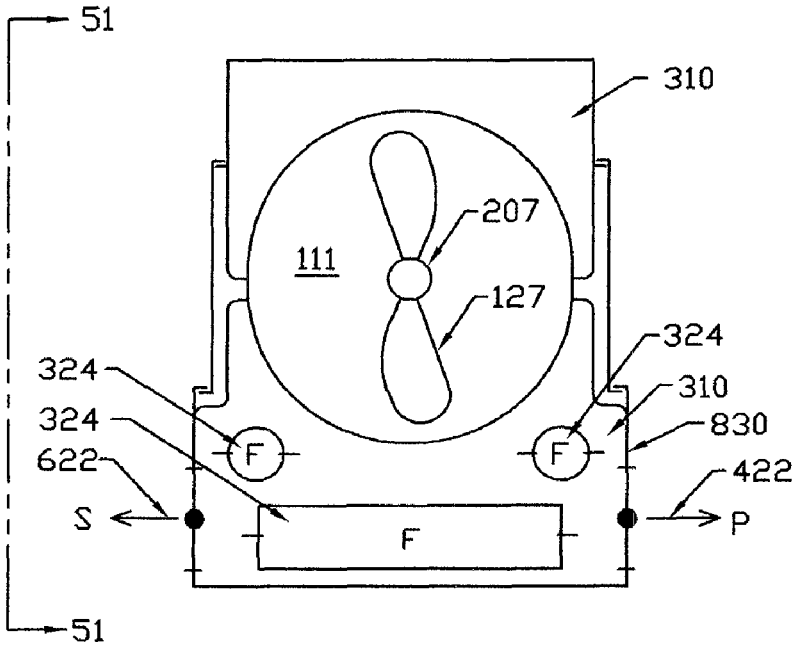
FIG. 52 is a forward end view of a three piece thrust bucket looking along Section lines 52-52 of FIG. 51 showing construction details of the thrust bucket including the annulus around the propeller and the water flow valves.

FIG. 52 is front end view of FIG. 51 as taken along Section line 52-52 and shows three forward water flow valves 324 in various configurations and locations.

Figure 53:
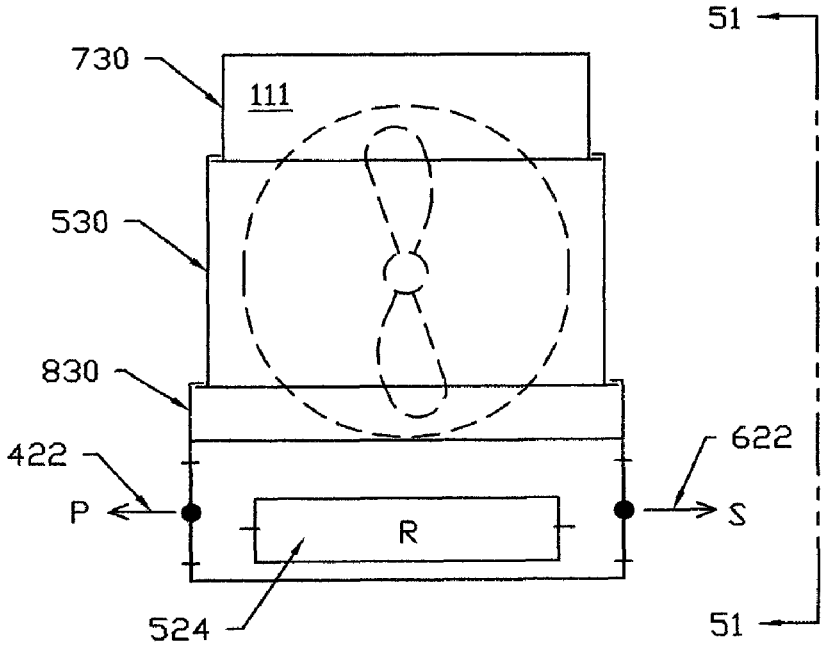
FIG. 53 is a rearward end view of a three piece thrust bucket looking along Section line 53-53 of FIG. 51 showing construction details that enable the three pieces to telescope together in a compact nest. The propeller and annulus are hidden by the object lines of the thrust bucket sections.

FIG. 53 is a rear end view of FIG. 51 as taken along Section line 53-53 and shows a large rearward water flow valve 524 as a rectangular butterfly valve.

Figure 54:
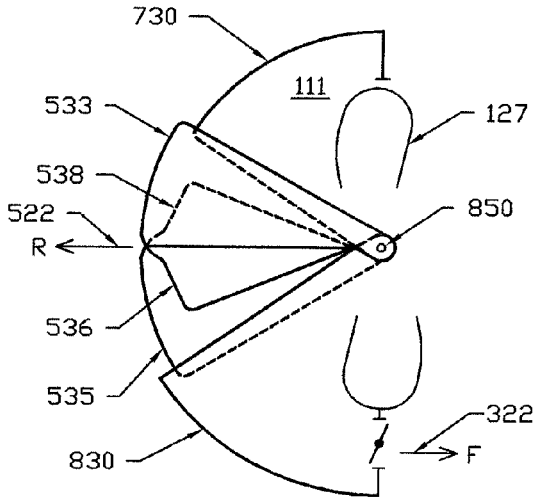
FIG. 54 is a side view of a four jaw thrust bucket surrounding the propeller partially shown as solid lines for clarity, but correctly should be dotted lines as indicating an object partially internal to the thrust bucket.

FIG. 54 is a view similar to FIG. 44 but also has features similar to FIG. 39 in particular how the middle jaw 530 of FIG. 44 is split into two jaws comprising upper middle jaw 533 and lower middle jaw 535 that open like the two jaws of FIG. 39 to emit rearward water jet 522 out the rear of the thrust bucket 111. FIG. 54 shows the jaws closed so there is no water flow, but the location of the water jet opening is shown for clarity.

Figure 55:
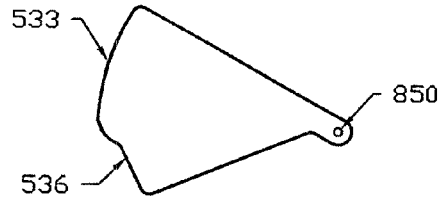
FIG. 55 is a side view of one of the four thrust bucket jaws that forms the upper center section of the thrust bucket assembly as shown in FIG. 54.

FIG. 55 is a side view of upper middle jaw 533 shown in FIG. 54 and shows the cheek 536 similar to cheek 913 of FIG. 38.

Figure 56:
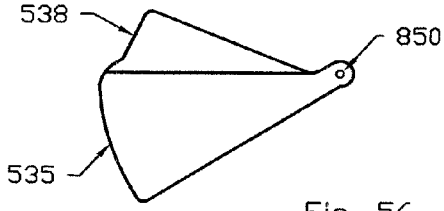
FIG. 56 is a side view of one of the four thrust bucket jaws as shown in FIG. 54 and which forms the lower center section of the thrust bucket assembly and is the mating half to the jaw shown in FIG. 55.

FIG. 56 is a side view of lower middle jaw 535 shown in FIG. 54 and shows the cheek 538 similar to cheek 913 of FIG. 38. Cheek 536 and 538 bypass each other closely to eliminate water leakage out the sides of the thrust bucket when the jaws are opened.

Figure 57:
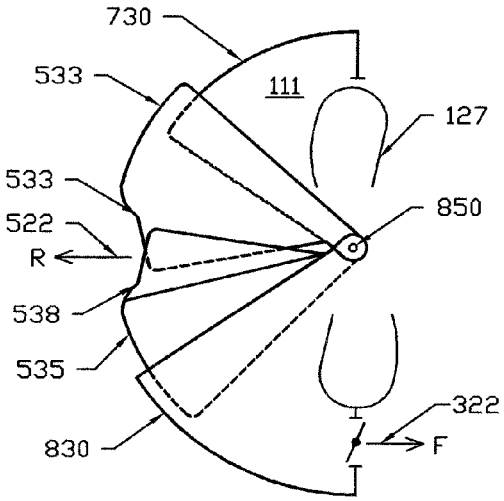
FIG. 57 is a side view of the thrust bucket of FIG. 54 showing the two center jaws of FIG. 55 and FIG. 56 partially open to allow water to exit rearward of the thrust bucket. These two jaws form a water flow valve by opening or closing as needed.

FIG. 57 is a side view similar to FIG. 54 and shows the upper middle jaw 533 and the lower middle jaw 535 slightly open to emit water out the rear of the thrust bucket 111 to form rearward water jet 522.

Figure 58:
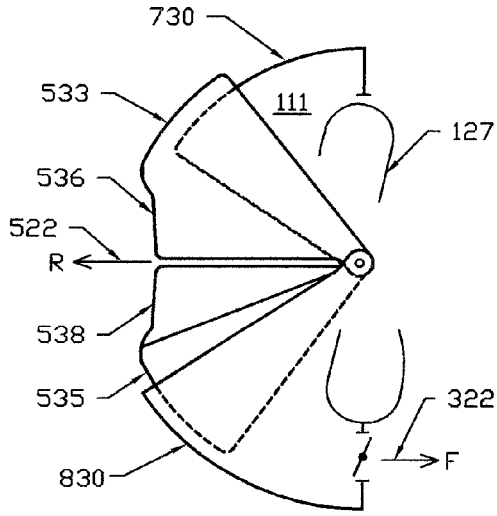
FIG. 58 is a side view of the thrust bucket of FIGS. 54 and 57 showing the two center jaws wide open to allow a large flow of water to exit rearward of the thrust bucket.

FIG. 58 is a side view similar to FIG. 57 and shows the upper middle jaw 533 and the lower middle jaw 535 wide open to emit water out the rear of the thrust bucket 111 to form the maximum flow of rearward water jet 522 and without leaking any water out the sides of the thrust bucket.

Figure 59:
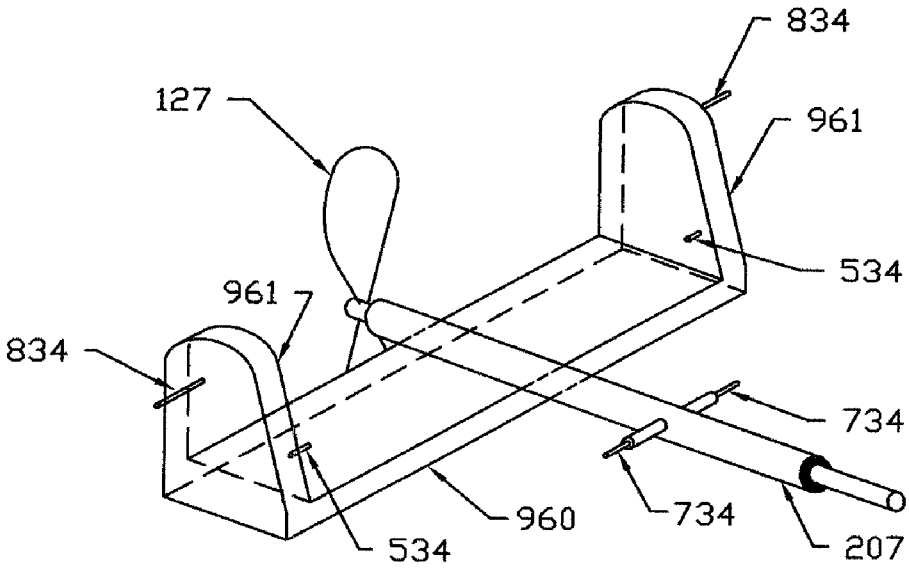
FIG. 59 is a top forward perspective view of a bracket shown in FIG. 60 as attached to the propeller shaft carrier and which provides the pivot points for each of the three thrust bucket jaws shown in FIG. 60.

FIG. 59 is a perspective view of a bracket that can be substituted for the mounting system of FIG. 50. As shown in FIG. 50, the thrust bucket jaws are connected at a common point at hinge pin 850 and are elevated by swing arms 815 to swing upward about hinge pin 820 attached to propeller shaft carrier 207. An alternate means in FIG. 59 comprises hinge pins 734 connected to propeller shaft carrier 207 and horizontal bracket 960 also connected to the propeller shaft carrier and includes vertical brackets 961 as part of the horizontal bracket 960 wherein hinge pins 534 are on the inside of the vertical brackets and hinge pins 834 are on the outside of the vertical brackets. This location of these hinge pins allows the separated jaws of the thrust bucket to swing upward and away from the entrance of the propeller when in the retracted position, yet allows them to form a leak tight assembly around the propeller when deployed.

Figure 60:
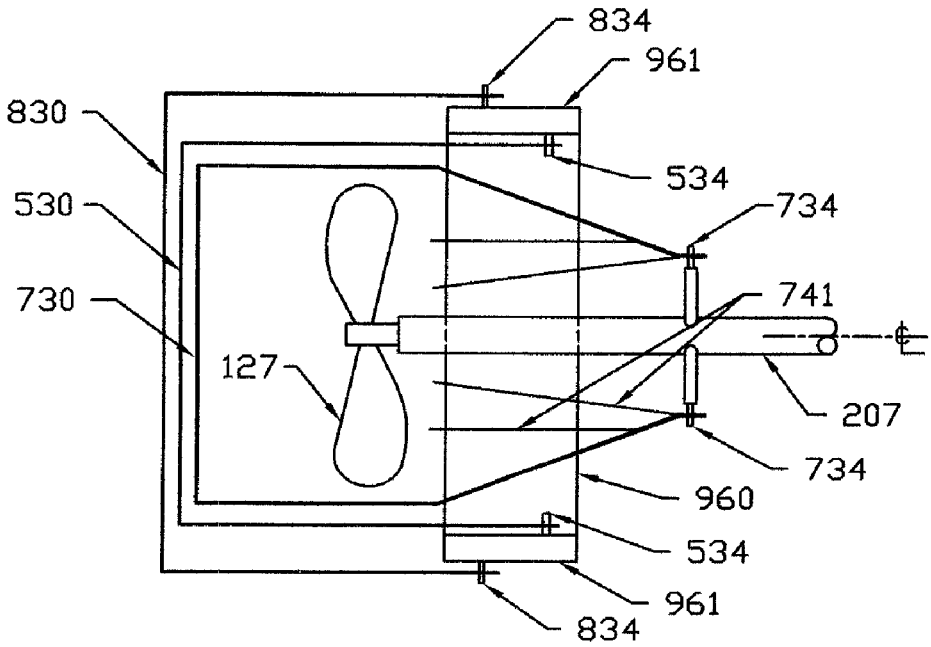
FIG. 60 is a top section view of a three piece thrust bucket according to another embodiment including the propeller and propeller shaft carrier looking along Section line 61-61 of FIG. 61. However for better clarity.

FIG. 60 is a top view similar to FIG. 48 but shows the use of the vertical brackets 961 and hinge pins as shown in FIG. 59 to carry the individual jaws of the thrust bucket. Each jaw is connected to a separate hinge pin. Top jaw 730 pivots about hinge pins 734, middle jaw 530 pivots about hinge pins 534, and bottom jaw 830 pivots about hinge pins 834. The respective pieces are shown rotated to the same horizontal position to illustrate relative nesting position, but which is not a normal operating position.

Figure 61:
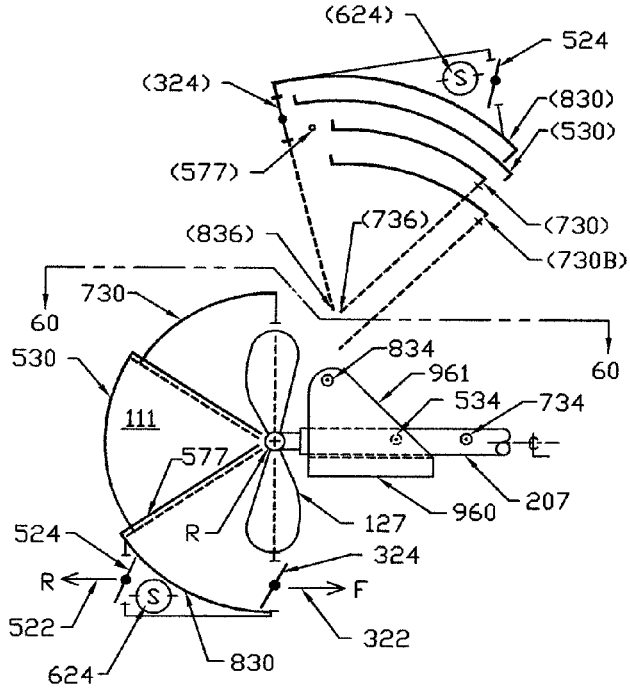
FIG. 61 is side view of FIG. 60 including a three piece thrust bucket and a propeller and a propeller shaft carrier with a mounting bracket of FIG. 59. The embodiment of FIG. 61 is similar to that of FIG. 44 but shows different pivot points for the bucket jaws to allow them to swing farther up and away from the propeller as shown in the upper portion of the view indicating the refracted position with the item numbers enclosed in parentheses. The back half of the propeller should correctly be shown as a dotted line to indicate it is hidden inside the confines of the thrust bucket.

FIG. 61 is a side view of FIG. 60 and is similar to FIG. 50 but uses a different pivot system than does FIG. 50. FIG. 61 shows how each of the separate jaws is hinged to swing up and away from the propeller 127 wherein upper jaw 730 is connected to hinge pins 734, middle jaw 530 is connected to hinge pins 534, and lower jaw 830 is connected to hinge pin 834. As each of the three jaws is swung up to the retracted position above the propeller, they form a compact nest that is desirable to minimize the space taken. Each of the three jaws in the raised position is indicated by parentheses around the item number. By way of example of an alternative to the three hinge pins as shown, it is possible to eliminate hinge pin 734 and simply pivot the upper jaw about hinge pin 534. This results in the upper jaw retracting to a lower position indicated as (730B) than was previously shown and which is not as desirable for maintaining a compact nest. Taking that thought even further, it is also possible to pivot all three jaws around a common pivot point (not shown) that is located forward and above the propeller center, but the jaws do not form as compact a nest as shown in FIG. 61 and that is usually undesirable because space on and around a boat is too valuable to waste.

Figure 62:
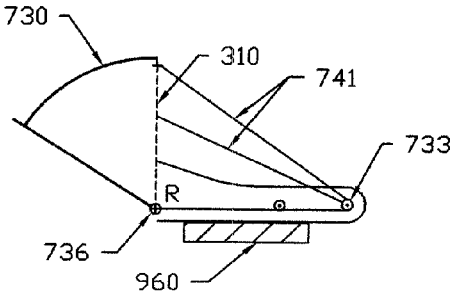
FIG. 62 is a side view of the upper jaw of the thrust bucket shown in FIG. 61 showing a pivot point location required for proper pivoting about the mounting bracket also shown in FIG. 59 and FIG. 60.

FIG. 62 is a side view of upper jaw 730 and shows how a portion of the jaw is extended forward on each side to include a hole 733 for hinge pin 734 and wherein the jaw extension provides a resting point on horizontal bracket 960 when deployed. A screen 741 comprised of wires, or the like, prevents objects from entering the propeller. Location R 736 coincides with a horizontal line through the hub of the propeller.

Figure 63:
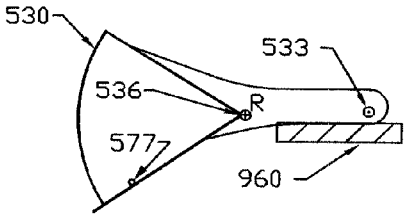
FIG. 63 is a side view of the center jaw of the thrust bucket shown in FIG. 61 showing the pivot point location required for proper pivoting about the mounting bracket also shown in FIG. 59 and FIG. 60.

FIG. 63 is a side view of middle jaw 530 and shows how a portion of the jaw is extended forward on each side to include a hole 533 for hinge pin 534 and wherein the jaw extension provides a resting point on horizontal bracket 960 when the thrust bucket is deployed. Location R 536 coincides with a horizontal line through the hub of the propeller.

Figure 64:
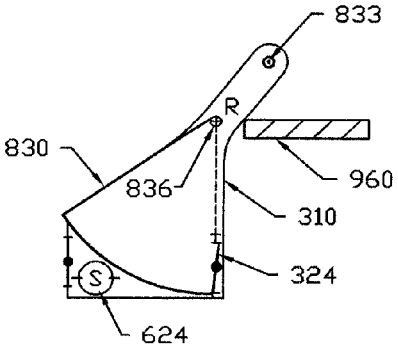
FIG. 64 is a side view of the bottom jaw of the thrust bucket shown in FIG. 61 showing a pivot point location required for proper pivoting about the mounting bracket also shown in FIGS. 59 and 60.

FIG. 64 is a side view of lower jaw 830 and shows how a portion of the jaw is extended forward on each side to include a hole 833 for hinge pin 834 and wherein the jaw extension provides a resting point on horizontal bracket 960 when the thrust bucket is deployed. Location R 836 coincides with a horizontal line through the hub of the propeller.

Figure 65:
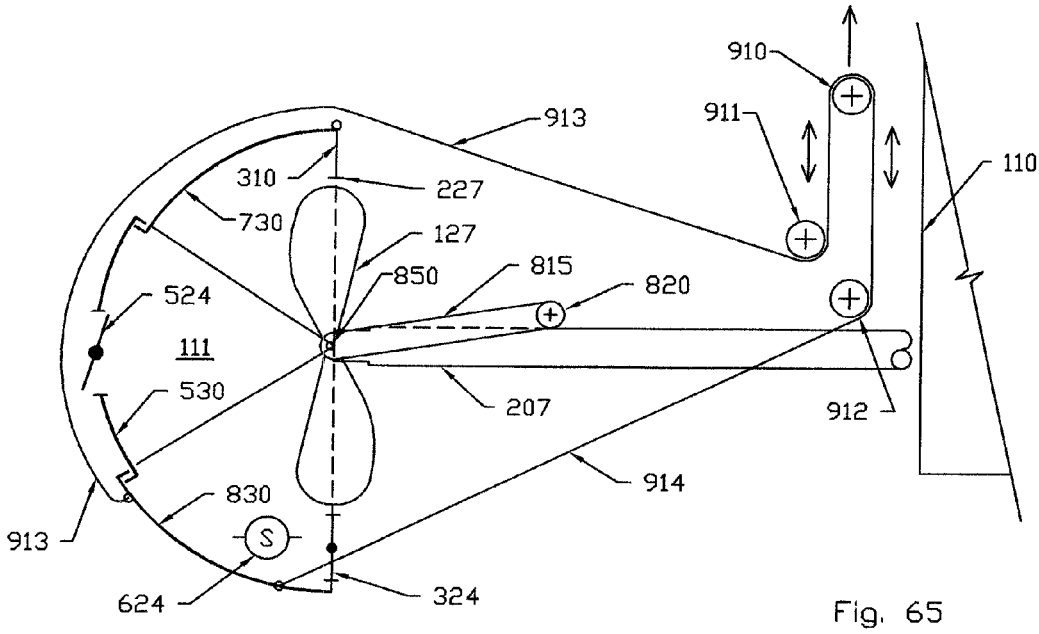
FIG. 65 is side view of a rear portion of a boat with a propeller attached to a propeller shaft carrier and shows a thrust bucket according to another embodiment which is similar to that shown in FIGS. 44 and 50.

FIG. 65 is a side view similar to FIG. 44 but further shows a means for deploying and retracting the thrust bucket 111 by means of a cable and pulley system. Cable 913 originates at the top of lower jaw 830 and wraps over the top of both the middle jaw 530 and the top jaw 730 and continues forward under pulley 911 and up and over pulley 910 then down and under pulley 912 and rearwards and downwards toward an attachment point on lower jaw 830. Cable 913 and cable 914 are held in tight position to hold the thrust bucket in the deployed position.

Figure 66:
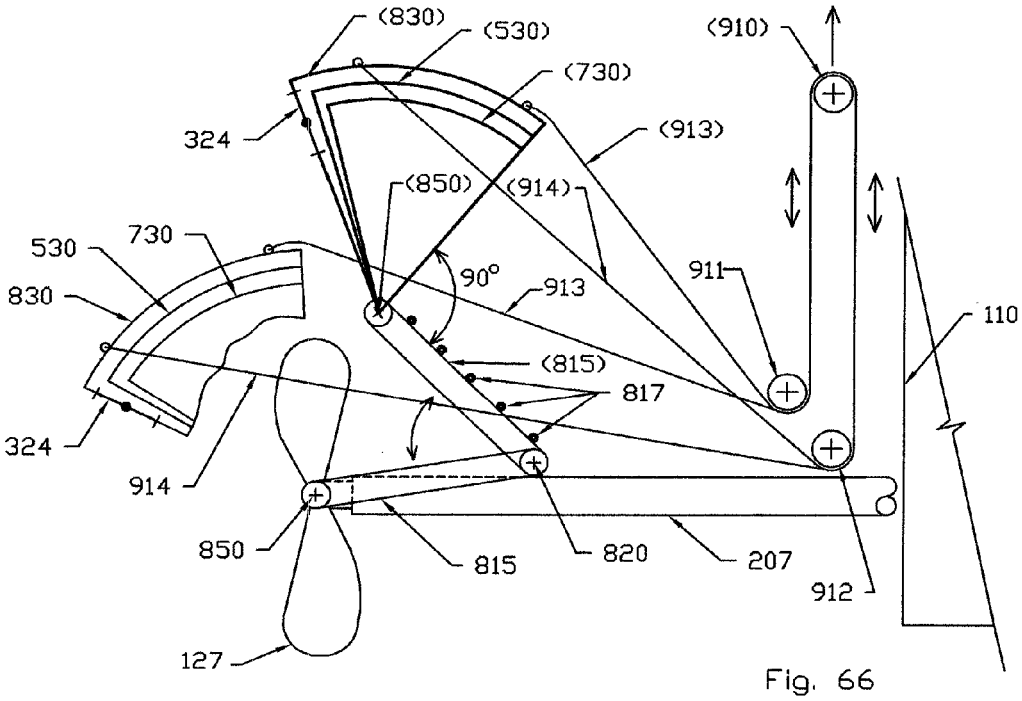
FIG. 66 is a side view of the propeller and thrust bucket equipment shown in FIG. 65 and shows the thrust bucket partially retracted and fully retracted as indicated by the item numbers enclosed in parentheses.

FIG. 66 is a side view of FIG. 65 and shows the thrust bucket 111 being retracted by means of tensioning cable 913 to cause the three jaws to pivot about point 850 and nest together as shown on the left end figure and ultimately be pivoted up on swing arms 815 that are hinged about pivot pins 820 to the fully raised position as shown by the item numbers in parentheses. Pulley 910 is caused to rotate clockwise to exert tension on cable 913 and is tensioned upward with a spring to take up any slack as the thrust bucket is refracted. Other means to tension and draw on the cables can be used and include force rams, not shown, that are attached to the cables. The sequence is reversed for deployment.

FIG. 67 is a top view of a one piece thrust bucket 111 that is functionally equivalent to FIG. 1 but includes an inlet screen 741 comprising stiff wires or rods or the like connected integrally to the thrust bucket to act as a forward extension of the thrust bucket. The forward two ends of the inlet screen are connected to a sliding carriage 970 by means of hinge pins 971 on either side of the sliding carriage. The sliding carriage moves forward and rearward along propeller shaft carrier 207 by means of carriage force ram 156 connected at one end to the sliding carriage and at the other end to the propeller shaft carrier. In this figure, the solid line image of the thrust bucket shows it residing in the forward and deployed position and shows the annulus 227 around the blade tips of propeller 127. The dotted line image of the rearward end of the thrust bucket shows it pushed back away from the propeller at an intermediate position to allow the thrust bucket to be lifted up and away from the propeller to the retracted position by means of thrust bucket lift ram 157.

FIG. 68 is a side view of FIG. 67 and shows the thrust bucket 111 in two positions. The drawing uses the same convention as FIG. 67 and shows thrust bucket as a solid line in the forward and deployed position and shows a dotted line image of the rearward end of the thrust bucket when it is pushed back away from the propeller 127 at an intermediate position to further allow the thrust bucket to be lifted up and away from the propeller to the retracted position. The thrust bucket is lifted by means of thrust bucket lift ram 157 connected at one end to clevis bracket 934 that is in turn connected to inlet screen 741 and at the other end to sliding carriage 970 by means of a ram bracket 158. A similar ram bracket 158 is used to connect carriage force ram 156 to propeller shaft carrier 207.

FIG. 69 is a side view similar to FIG. 68 and shows thrust bucket 111 in the retracted position up and away from propeller 127. Thrust bucket lift ram 157 is in the retracted position and carriage force ram 156 is in the extended position to allow the thrust bucket to clear the blade tips of propeller 127. Once the thrust bucket is in the up position, the carriage force ram can be retracted to allow more air flow into the top of the propeller.

Figure 70:
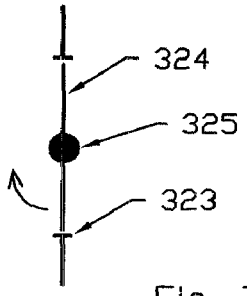
FIGS. 70 and 71 illustrate a butterfly type water flow valves for use on the thrust buckets shown in the closed position (FIG. 70) and in the open position (FIG. 71).

FIG. 70 is a schematic drawing of a water flow valve commonly known as a butterfly valve and is comprised of a valve shaft 325, a valve wafer 324, and a valve orifice 323. The valve wafer is connected to the valve shaft and together they rotate to open or close the valve wafer in the valve orifice. FIG. 70 shows the water flow valve in the closed position.

Figure 71:
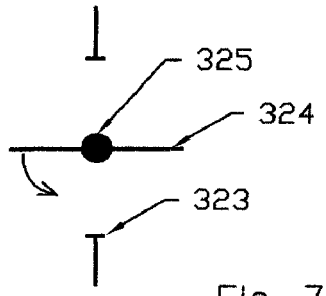

FIG. 71 is the same as FIG. 70 but shows the water flow valve in the open position.

Figure 72:
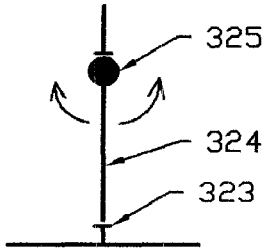
FIG. 72 is a schematic diagram of a side view of a swing gate valve in the closed position.

FIG. 72 is a schematic drawing of a water flow valve commonly known as a swing gate valve and is comprised of a valve shaft 325, a valve wafer 324, and a valve orifice 323. The valve wafer is connected to the valve shaft and together they rotate to open or close the valve wafer in the valve orifice. FIG. 72 shows the water flow valve in the closed position.

Figure 73:
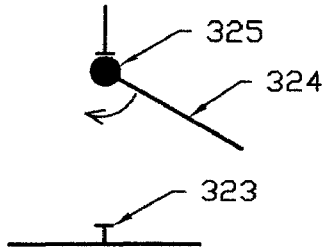
FIG. 73 is another view of the swing gate valve of FIG. 72 and shows the swing gate valve in the open position.

FIG. 73 is the same as FIG. 72 but shows the water flow valve in the open position.

Figure 74:
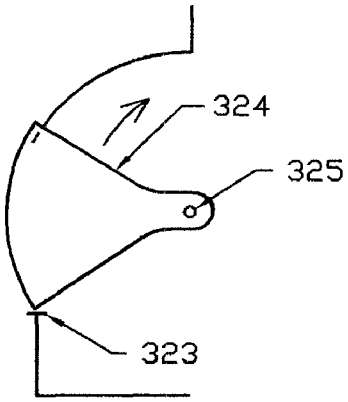
FIG. 74 is a schematic diagram of a side view of a "Tainter" style gate valve that is similar to some of the jaws of the thrust bucket.

FIG. 74 is a schematic drawing of a water flow valve commonly known as a "Tainter" gate and is comprised of a valve shaft 325, a valve gate 324, and a valve orifice 323. A Tainter gate allows large flows of water when a small amount of leakage is not a major concern. FIG. 39 and FIG. 54 are somewhat like a Tainter gate or a pair of Tainter gates in opposition. FIG. 74 shows the water flow valve in the closed position.

Figure 75:
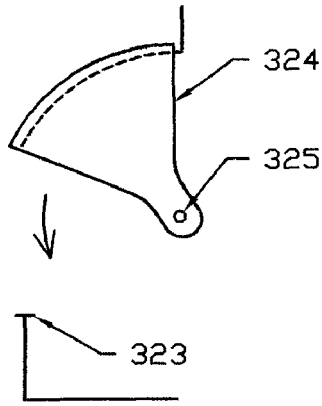
FIG. 75 is another view of the "Tainter" valve of FIG. 74 showing the "Tainter" in the open position.

FIG. 75 is the same as FIG. 74 but shows the water flow valve in the open position.

Figure 76:
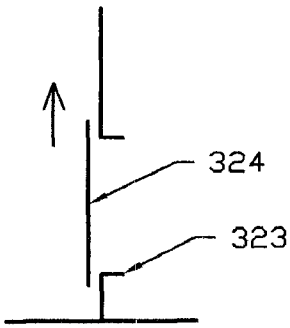
FIG. 76 is a schematic diagram of a side view of a slide gate valve in the closed position.

FIG. 76 is a schematic drawing of a water flow valve commonly known as a slide gate valve and is comprised of a valve wafer 324, and a valve orifice 323. The valve wafer slides up and down in a groove to allow water to flow through the valve orifice. FIG. 76 shows the water flow valve in the closed position.

Figure 77:
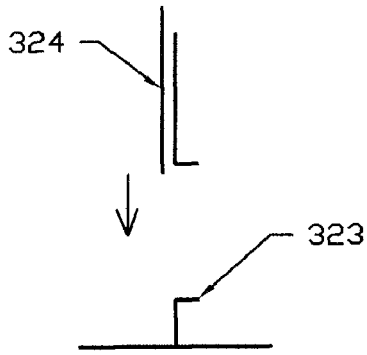
FIG. 77 is another view of the slide gate valve of FIG. 76 and shows the slide gate valve in the open position.

FIG. 77 is the same as FIG. 76 but shows the water flow valve in the open position rather than in the closed position.

Although the present invention has been described in considerable detail with reference to certain preferred versions thereof, other versions and variations are possible and contemplated. Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

The invention claimed is:

1. A thrust bucket for use on a boat having a propeller, comprising:

a plenum comprising a plenum wall with at least one water flow valve located on said plenum wall; and a positioning system which moves said plenum between inoperative and operative positions, wherein said plenum is configured to form a chamber at an operative chamber location for receiving water from the propeller when said plenum is in said operative position, and wherein said plenum is moved to only one side relative to said operative chamber location when moved to said inoperative position.

2. The thrust bucket of claim 1, wherein said plenum further comprises an annulus which is configured to be positioned in close proximity to a swept radius of the propeller when said plenum is in said operative position.

3. The thrust bucket of claim 2, wherein said annulus is generally circular.

4. The thrust bucket of claim 2, wherein said annulus is configured to minimize leakage of water around the propeller when said plenum is in said operative position.

5. The thrust bucket of claim 1, wherein said at least one operable water flow valve is controlled to control a direction of water departing said plenum.

6. The thrust bucket of claim 1, wherein said at least one water flow valve is controlled to control a quantity of water flow out of said plenum.

7. The thrust bucket of claim 1, wherein said at least one water flow valve comprises at least one of a forward water flow valve, a rearward water flow valve, a port water flow valve, and a starboard water flow valve.

8. The thrust bucket of claim 1, wherein said at least one water flow valve comprises at least two of a forward water flow valve, a rearward water flow valve, a port water flow valve, and a starboard water flow valve, and wherein each water flow valve is independently controlled.

9. The thrust bucket of claim 1, further comprising a propeller guard mounted to said plenum and configured to be positioned at an inlet side of the propeller when said plenum is in said operative position.

10. A thrust bucket for use on a boat having a propeller, comprising:

a plenum comprising a plurality of retractable plenum walls; and a positioning system which moves said plenum between a retracted position and a deployed position, wherein said plenum is configured to form a chamber at a deployed chamber location for receiving water from the propeller when said plenum is in said deployed position and wherein said plenum is moved to only one side relative to said deployed chamber location when moved to said retracted position.

11. The thrust bucket of claim 10, wherein said plurality of retractable plenum walls nest together in said retracted position.

12. The thrust bucket of claim 10, further comprising at least one water flow valve positioned on at least one of said plurality of retractable plenum walls.

13. The thrust bucket of claim 10, wherein said plurality of retractable plenum walls are moved relative to each other to form at least one water flow valve.

14. The thrust bucket of claim 13, wherein said positioning system independently moves each of said plurality of retractable plenum walls.

15. The thrust bucket of claim 10, further comprising a portion of an annulus provided on at least one of said plurality of retractable plenum walls, wherein said portion of said annulus is configured to be positioned in close proximity to a swept radius of the propeller when said plenum is in said deployed position.

16. The thrust bucket of claim 15, wherein said portion of said annulus is generally circular.

17. The thrust bucket of claim 15, wherein said portion of said annulus is configured to minimize leakage of water around the propeller when said plenum is in said deployed position.

18. The thrust bucket of claim 10, further comprising a propeller guard mounted to said plenum and positioned at an inlet side of the propeller.

19. A boat, comprising:

a hull and a propeller; and a thrust bucket, comprising:

a plenum comprising a plenum wall with at least one water flow valve located on said plenum wall; and a positioning system which moves said plenum between inoperative and operative positions, wherein said plenum is positioned in close proximity to said propeller when said plenum is in said operative position, and wherein said plenum is removed away from said propeller in said inoperative position.

20. The boat of claim 19, further comprising an annulus positioned in close proximity to a swept radius of said propeller when said plenum is in said operative position.

21. The boat of claim 19, wherein said at least one operable water flow valve is controlled to control a direction of water departing said plenum.

22. A boat, comprising:

a hull and a propeller; and a thrust bucket, comprising:

a plenum comprising a plurality of retractable plenum walls; and a positioning system which moves said plenum between a retracted position and a deployed position, wherein said plenum is positioned in close proximity to said propeller when said plenum is in said deployed position, and wherein said plenum is removed away from said propeller in said retracted position.

23. The boat of claim 22, wherein said plurality of retractable plenum walls nest together in said refracted position.

24. The boat of claim 22, further comprising at least one water flow valve positioned on at least one of said plurality of retractable plenum walls.

25. The boat of claim 22, wherein said plurality of retractable plenum walls are moved relative to each other to form at least one water flow valve.

26. The boat of claim 22, further comprising a portion of an annulus provided on at least one of said plurality of retractable plenum walls, wherein said portion of said annulus is positioned in close proximity to a swept radius of the propeller when said plenum is in said deployed position.

* * * * *